US007190123B2

(12) United States Patent
Lee

(10) Patent No.: US 7,190,123 B2
(45) Date of Patent: Mar. 13, 2007

(54) CIRCUIT STRUCTURE FOR DRIVING A PLURALITY OF COLD CATHODE FLUORESCENT LAMPS

(75) Inventor: Sheng Tai Lee, Taipei (TW)

(73) Assignee: O2Micro International Limited, Grand Cayman (KY)

( * ) Notice: Subject to any disclaimer, the term of this patent is extended or adjusted under 35 U.S.C. 154(b) by 79 days.

(21) Appl. No.: 10/924,585

(22) Filed: Aug. 24, 2004

(65) Prior Publication Data

US 2005/0023998 A1 Feb. 3, 2005

Related U.S. Application Data

(63) Continuation of application No. 10/383,277, filed on Mar. 7, 2003, now Pat. No. 6,781,325.

(30) Foreign Application Priority Data

Apr. 12, 2002 (TW) ..... 91135220 A
Feb. 26, 2003 (TW) ..... 92104106 A

(51) Int. Cl.
*H05B 37/02* (2006.01)

(52) U.S. Cl. ..... 315/224; 315/276; 315/282; 315/312; 315/325; 363/21.07; 363/21.09; 363/34

(58) Field of Classification Search ..... 315/209 R, 315/224, 291, 307, 276, 282, 312, 324, 325, 315/DIG. 7; 363/15–17, 21.07, 21.09, 22–25, 363/34, 98, 132
See application file for complete search history.

(56) References Cited

U.S. PATENT DOCUMENTS 5,051,667 A * 9/1991 Dunham ..... 315/307
5,930,121 A * 7/1999 Henry ..... 363/16
6,130,509 A * 10/2000 Kates et al. ..... 315/224
6,310,444 B1 * 10/2001 Chang ..... 315/282
6,420,839 B1 * 7/2002 Chiang et al. ..... 315/311
6,534,934 B1 * 3/2003 Lin et al. ..... 315/312

OTHER PUBLICATIONS

English translation of Chinese Office Action from related Chinese application (2 pgs).
English translation of Second Office Action from related Chinese application, dated Mar. 3, 2006.

* cited by examiner

*Primary Examiner*—Haissa Philogene
(74) *Attorney, Agent, or Firm*—Grossman, Tucker, Perreault & Pfleger PLLC

(57) ABSTRACT

A DC/AC converter circuit structure for driving a plurality of cold cathode fluorescent lamps is described. A common-mode choke is used between the cold cathode fluorescent lamps. The common-mode choke balances the currents respectively flowing through the cold cathode fluorescent lamps.

20 Claims, 19 Drawing Sheets

5 μs BWL
1 .1 V DC
2 20mV DC
3 10mV DC
4 10mV DC

4 DC 50mV

100MS/s

STOPPED

CIRCUIT STRUCTURE FOR DRIVING A PLURALITY OF COLD CATHODE FLUORESCENT LAMPS

CROSS REFERENCE TO RELATED APPLICATIONS

This application is a continuation of U.S. Nonprovisional application Ser. No. 10/383,277 filed Mar. 7, 2003 now U.S. Pat. No. 6,781,325, the teachings of which are herein incorporated by reference.

FIELD OF THE INVENTION

The present invention relates to a driver circuit, and more specifically, to a circuit for driving cold cathode fluorescent lamps.

BACKGROUND OF THE INVENTION

Both the notebook computers and the portable electronic apparatus use the cold cathode fluorescent lamp as a back-light because this lamp has the best illumination efficiency. Therefore, the cold cathode fluorescent lamp has quickly been adopted for use as the backlight in PDAs, notebook computers and portable electronic apparatus. The quality requirement of the converter for the cold cathode fluorescent lamp is also increased.

A high voltage DC/AC converter is required to drive the cold cathode fluorescent lamp because this lamp uses a high AC operation voltage. However, with the increasing size of the LCD panel, the panel requires multiple lamps to provide the necessary illumination. Therefore, an effective converter is required to drive multiple cold cathode fluorescent lamps. The driving technique requires careful treatment.

FIG. 1 shows a schematic drawing of a circuit structure for an DC/AC converter used to drive two cold cathode fluorescent lamps in accordance with the prior art. DC power 100 provides DC power to the full bridge circuit 102. DC power 100 is connected to a primary winding 104 of a transformer through the full bridge circuit 102. The secondary winding 106 of a transformer is coupled to two cold cathode fluorescent lamps 112 and 114 through two high voltage capacitors 108 and 110, respectively. A half-bridge circuit, a push-pull circuit or a Royer circuit can be used to replace the full bridge circuit 102. However, this circuit structure does not ensure that each cold cathode fluorescent lamp connected with the circuit structure is ignited successfully. The characteristics of the cold cathode fluorescent lamp is negative resistance and the voltage needed to ignite the lamp is different under various conditions such as aging of the lamp, temperature of the lamp and parasitic coupling between and lamp and the metal chassis. For example, one of the two cold cathode fluorescent lamps connected in this circuit structure is severely aged, the circuit cannot ignite the lamp due to the voltage at the transformer decreases once the other lamp has ignited. This, in turn, decreases the life-span of the cold cathode fluorescent lamps.

FIG. 2 shows a schematic drawing of another circuit structure schematic drawing for a DC/AC converter that used to drive two cold cathode fluorescent lamps in accordance with the prior art. DC power 100 provides DC power to the full bridge circuit 102. DC power 100 is connected to a primary winding 104 of a transformer through the full bridge circuit 102. The secondary winding 106 of a transformer is coupled to two cold cathode fluorescent lamps 112 and 114 through an inductor 116 and two high voltage capacitors 108 and 110, respectively. A half-bridge, a push-pull or a Royer circuit can be used to replace the full bridge circuit 102. However, this circuit structure uses an inductor 116 between the secondary winding 106 and two high voltage capacitors 108 and 110, which may cause this circuit structure to be affected easily by an operation frequency associated with a DC/AC power converter. The variation of operating frequency may cause different AC currents to flow through the two cold cathode fluorescent lamps 112 and 114, respectively. In addition, this circuit structure is also sensitive to load variations. Therefore, if this circuit structure is used to drive multiple cold cathode fluorescent lamps, it is difficult to balance the current flowing through each lamp. Moreover, circuit design is difficult and complicated.

FIG. 3 shows a schematic drawing of a circuit structure of a plurality of transformers that are used to drive a plurality of cold cathode fluorescent lamps in accordance with the prior art. It is used to solve the problems described in the two circuit structures shown in FIG. 1 and FIG. 2. DC power 100 provides DC power to the full bridge circuit 102. DC power 100 is connected to two primary windings 104*a* and 104*b* through the full bridge 102. The secondary windings 106*a* and 106*b* are coupled to two cold cathode fluorescent lamps 112 and 114 through two high voltage capacitors 122 and 124, respectively. A half-bridge circuit, a push-pull circuit or a Royer circuit can be used to replace the full bridge circuit 102. Although this circuit structure increases the reliability and stability, structural formation of this kind of DC/AC converter for driving a cold cathode fluorescent lamp is expensive. Furthermore, a DC/AC converter with this circuit structure is bulky.

SUMMARY OF THE INVENTION

In accordance with the foregoing description, there are many drawbacks in the conventional DC/AC converters when driving a plurality of cold cathode fluorescent lamps. For example, the first circuit structure depicted in the FIG. 1 cannot ensure that each lamp is ignited. The second circuit structure depicted in the FIG. 2 is easily affected by the operating frequency. Moreover, it is difficult to balance the current flowing through each lamp. Further, the technique of using a plurality of DC/AC converters to drive a plurality of cold cathode fluorescent lamps as depicted in the FIG. 3 is expensive and large in size.

Therefore, the main purpose of the present invention is to provide a circuit structure for driving a plurality of cold cathode fluorescent lamps to solve the problems existing in the prior arts.

Another purpose of the present invention is to provide an DC/AC converter for driving a plurality of cold cathode fluorescent lamps that is not affected by the variation of the back-light module including the chassis and the cold cathode fluorescent lamps.

Another purpose of the present invention is to provide a DC/AC converter structure for driving a plurality of cold cathode fluorescent lamps that is not affected by operating frequency of a DC/AC power converter. Therefore, the circuit structure may balance the current flowing through each lamp.

The present invention provides a DC/AC converter structure for driving a plurality of cold cathode fluorescent lamps. This structure utilizes a common-mode choke between the load that is connected to the secondary winding of a transformer in the DC/AC converter. This common-mode choke balances the current flowing through each lamp so that each lamp provides same amount of luminance. Moreover, this circuit structure is not affected by the operating frequency of the DC/AC power converter.

In accordance with the circuit structure, one examplary circuit is to drive three or more loads. The circuit adds an additional common-mode choke between the third load and the first load. The current flowing through these loads are balanced via the characteristics of the common-mode choke. Such a circuit structure realizes an DC/AC converter that drives a plurality of loads and the current flowing through these loads are equal. Moreover, the balance of the current among the loads is not affected by the number of the loads.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein.

DETAILED DESCRIPTION OF THE PREFERRED EMBODIMENT

Without limiting the spirit and scope of the present invention, the circuit structure proposed in the present invention is illustrated with four preferred embodiments. One with ordinally skill in the art, upon acknowledging the embodiments, can apply the circuit structure of the present invention to various converter topologies. The circuit structure of the present invention allows uniform and simultaneous illumination of all lamps. The present invention also balances current among all lamps by using of common-mode chokes in the circuit structure. Additionally, the present invention only requires a secondary winding of a transformer to drive a plurality of cold cathode fluorescent lamps. Therefore, the size of the transformer is reduced. The application of the present invention is not limited by the preferred embodiments described in the following.

Figure 1:
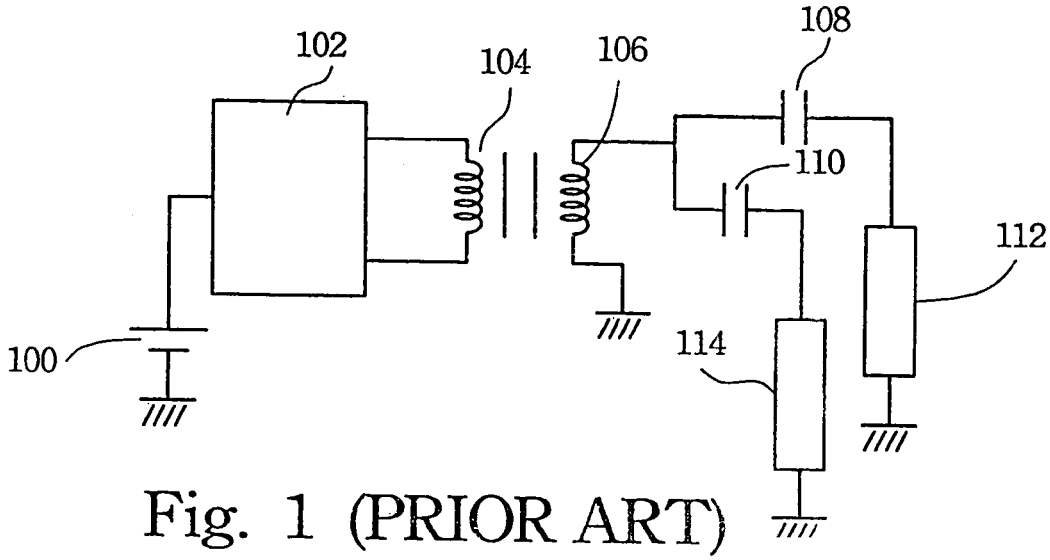
Fig. 1 (PRIOR ART)
FIG. 1 is a schematic drawing of a circuit structure for an DC/AC converter used to drive two cold cathode fluorescent lamps in accordance with the prior art.
Figure 2:
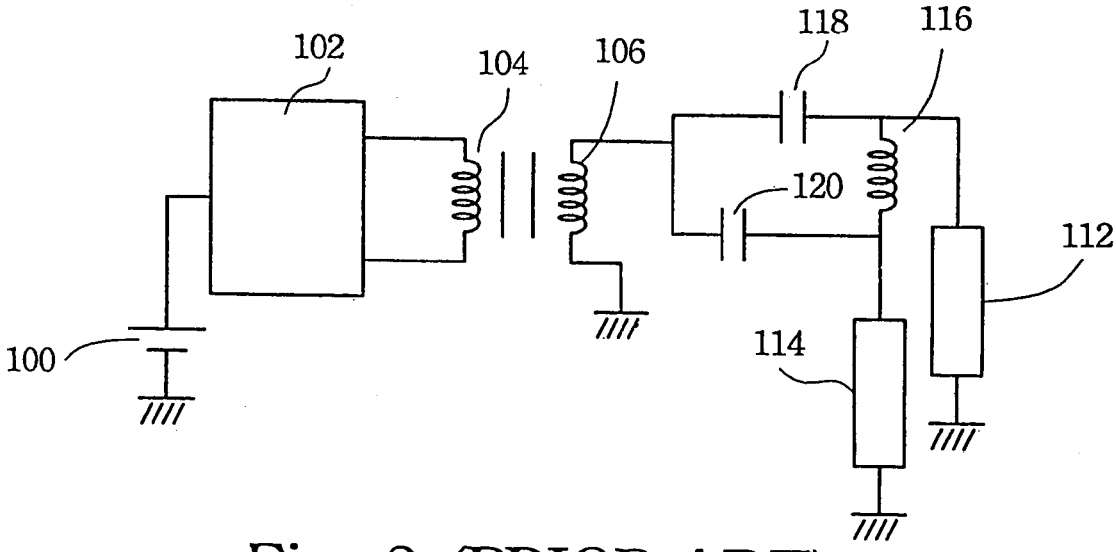
Fig. 2 (PRIOR ART)
FIG. 2 is a schematic drawing of another circuit structure for an DC/AC converter that is used to drive two cold cathode fluorescent lamps in accordance with the prior art, wherein an inductor is used to connect the load.
Figure 3:
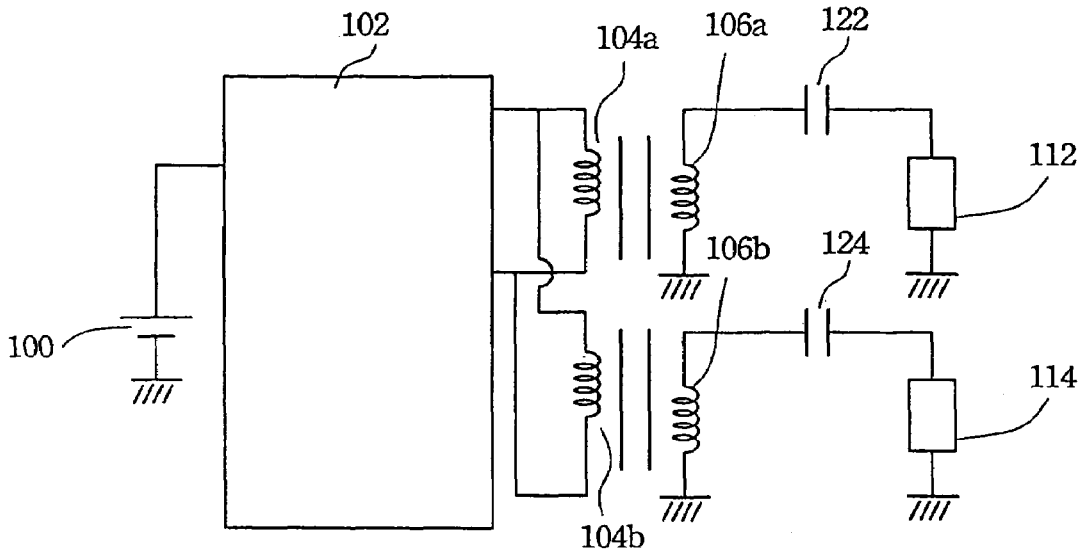
Fig. 3 (PRIOR ART)
FIG. 3 is a schematic drawing of another circuit structure for a plurality of transformers used to drive a plurality of cold cathode fluorescent lamps in accordance with the prior art.
Figure 4:
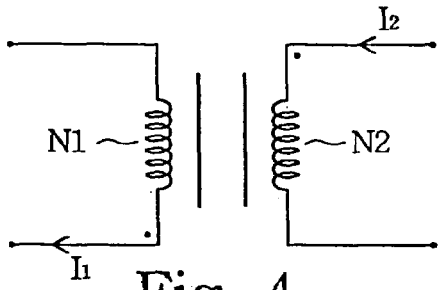
FIG. 4 is a schematic drawing of a common-mode choke in accordance with the present invention.

The present invention provides a DC/AC converter circuit structure for driving a plurality of cold cathode fluorescent lamps. This circuit structure uses a common-mode choke between the loads that is connected to the secondary winding of a transformer in the DC/AC converter structure. This common-mode choke balances the current flowing through the loads. FIG. 4 is a common-mode choke schematic drawing in accordance with the present invention. The current flowing through the primary winding $N_1$ in the common-mode choke is $I_1$. The current flowing through the secondary winding $N_2$ in the common-mode choke is $I_2$. The following is a basic formula in accordance with the principle of the transformer.

$$N_1 \times I_1 - N_2 \times I_2 = 0$$

$$I_1/I_2 = N_2/N_1$$

Current $I_1$ and current $I_2$ are equal when the primary winding $N_1$ and the secondary winding $N_2$ are designed to have the same number of turns and reversed polarity. Therefore, the common-mode choke ensures that the currents flowing through the cold cathode fluorescent lamps are equal by designing the common-mode choke having the same number of turns N1 and N2 where the primary winding $N_1$ and the secondary winding $N_2$ in the common-mode choke are connected to cold cathode fluorescent lamps respectively.

Figure 5A:
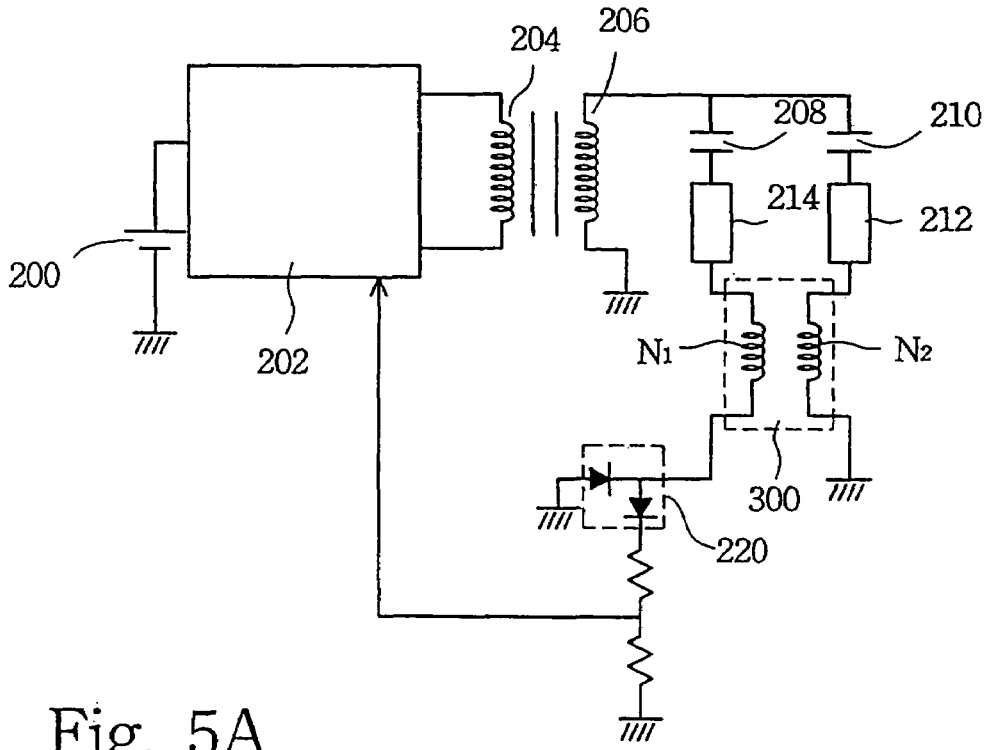
FIG. 5A is a schematic drawing where the common-mode choke is applied in an DC/AC converter to drive two cold cathode fluorescent lamps in accordance with the first embodiment of the present invention.

FIG. 5A is a schematic drawing of the common-mode choke 300 applied in a DC/AC converter to drive cold cathode fluorescent lamps in accordance with the first embodiment of the present invention. A DC power 200 provides a DC power to the full bridge circuit 202. This DC power 200 is connected to a primary winding 204 of a transformer through the full bridge circuit 202. The secondary winding 206 of a transformer is coupled to two cold cathode fluorescent lamps 212 and 214 through two high voltage capacitors 208 and 210, respectively. The two cold cathode fluorescent lamps 212 and 214 are connected to the first winding $N_1$ and the second winding $N_2$ of the common-mode choke 300 of the present invention respectively. The cold cathode fluorescent lamp 214 is connected to the first winding $N_1$ and the cold cathode fluorescent lamp 212 is connected to the second winding $N_2$. The output of the common-mode choke 300 is connected to a dual diode 220 to feed back the current on the output of the full bridge circuit 202. This feedback signal is received and the controller in the full bridge circuit 202 regulates the power to the output. A half-bridge circuit, a push-pull circuit or a Royer circuit can replace the full bridge circuit 202. The structure of the common-mode choke is similar to the structure of a transformer. The material of the common-mode choke 300 is MPP Powder Core, Micrometals Powdered Iron Core, Ferrite EE-core, Pot-Core or Toroid core.

Figure 5B:
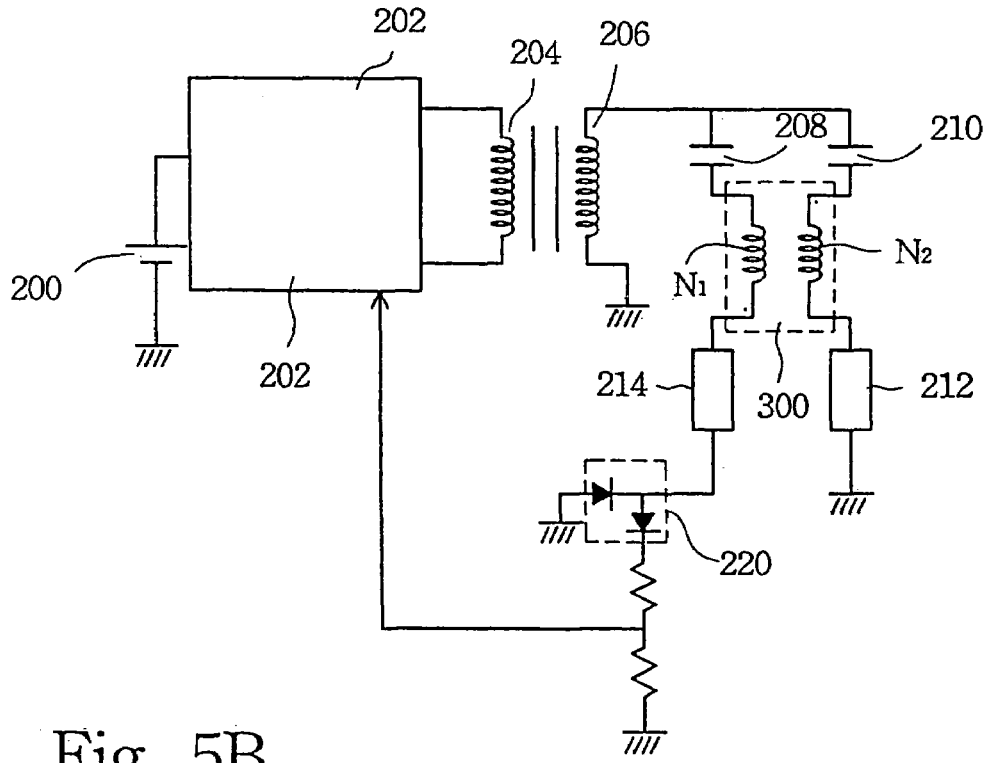
FIG. 5B is a schematic drawing of the common-mode choke applied in an DC/AC converter to drive two cold cathode fluorescent lamps in accordance with the second embodiment of the present invention.

FIG. 5B is a schematic drawing of the common-mode choke 300 applied to a DC/AC converter to drive two cold cathode fluorescent lamps in accordance with the second embodiment of the present invention. A DC power 200 provides DC power to the full bridge circuit 202. DC power 200 is connected to a primary winding 204 of a transformer through the full bridge circuit 202. The secondary winding 206 of a transformer is coupled to the two input ends of the common-mode choke 300 of the present invention through two high voltage capacitors 208 and 210, respectively. The two output ends of the common-mode choke 300 are respectively connected to the two cold cathode fluorescent lamps 212 and 214. The cold cathode fluorescent lamp 214 is connected to the first winding $N_1$ and the cold cathode fluorescent lamp 212 is connected to the second winding $N_2$. The other end of the cold cathode fluorescent lamp 214 is connected to a dual diode 220 to feed back the current on the output end of the cold cathode fluorescent lamp 214 to the full bridge circuit 202. A half-bridge circuit, a push-pull circuitor a Royer circuit can be used to replace the full bridge circuit 202. The structure of the common-mode choke is similar to the structure of a transformer. The material of the common-mode choke 300 is MPP Powder Core, Micrometals Powdered Iron Core, Ferrite EE-core, Pot-Core or Toroid core.

In other words, the common-mode choke 300 of the present invention can be located on the high voltage side or the low voltage side of the cold cathode fluorescent lamp. The common-mode choke 300 balances the current flowing through the first winding $N_1$ and the current flowing through the second winding $N_2$ by the design of the common-mode choke 300.

The inductor value in the common-mode choke 300 used in the FIG. 5A can be solved by the method described in the following. In calculations, two loads $R_1$ and $R_2$ are used to replace the two cold cathode fluorescent lamps 212 and 214 because the cold cathode fluorescent lamp possesses a negative resistance characteristics. Therefore, the voltage difference between the input end and the output end of the cold cathode fluorescent lamp 212 is $V_{R1}$. The voltage difference between the input end and the output end of the cold cathode fluorescent lamp 214 is $V_{R2}$. The following formulas are obtained in accordance with Kirchhoff's Law:

$$V_O = V_{208} + V_{R1} + V_{L1} \tag{1}$$

$$V_O = V_{210} + V_{R2} - V_{L2} \tag{2}$$

$V_O$ is the output voltage of the secondary winding 206 of the transformer. $V_{208}$ is the voltage value between the two ends of the high voltage capacitor 208. $V_{L1}$ is the voltage value of the first winding $N_1$ of the common-mode choke 300. $V_{L2}$ is the voltage value of the second winding $N_2$ of the common-mode choke 300.

Next, a complex number is used to replace the inductor and capacitor value. The capacitance of both the high voltage capacitor 208 and 210 is C. The inductance of both the first winding $N_1$ and the second winding $N_2$ of the common-mode choke 300 is L. The coupling coefficient of the common-mode choke 300 is K. The following formula is obtained by calculating equations (1) and (2).

$$(R_1^2 - R_2^2) = \frac{4L}{C}(1 - K) \tag{3}$$

Therefore, the inductance of the common-mode choke can be obtained from equation (3). For example, the inductance of both the first winding $N_1$ and the second winding $N_2$ of the common-mode choke are 409 mH when resistor $R_1$ has a resistance of 120K ohm, resistor $R_2$ has a resistance of 90K ohm, the coupling coefficient of the common-mode choke is 0.85 and the capacitance values of both the high voltage capacitors are 39 Pf.

Figure 6:
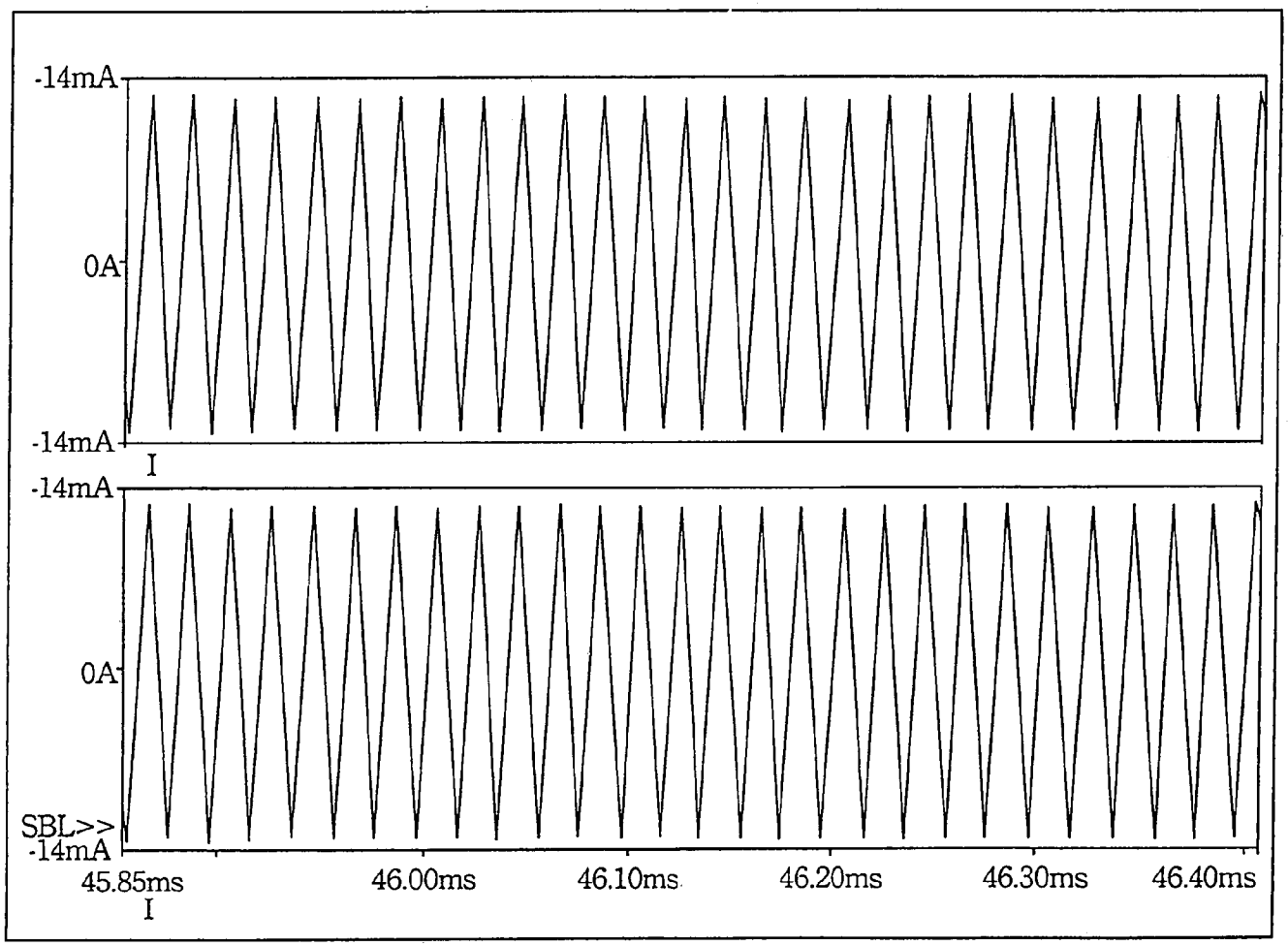
FIG. 6 is a schematic drawing comparing the current flowing through two cold cathode fluorescent lamps when applying the DC/AC converter to the two cold cathode fluorescent lamps in accordance with the first embodiment of the present invention.

FIG. 6 is a drawing comparing the current flowing through the two cold cathode fluorescent lamps when the DC/AC converter is used to drive two cold cathode fluorescent lamps in accordance with the first embodiment of the present invention. In accordance with the comparison drawing, the current flowing through the two cold cathode fluorescent lamps are almost equal. Obviously, the circuit structure of the present invention balances the currents respectively flowing through the two cold cathode fluorescent lamps.

Figure 7A:
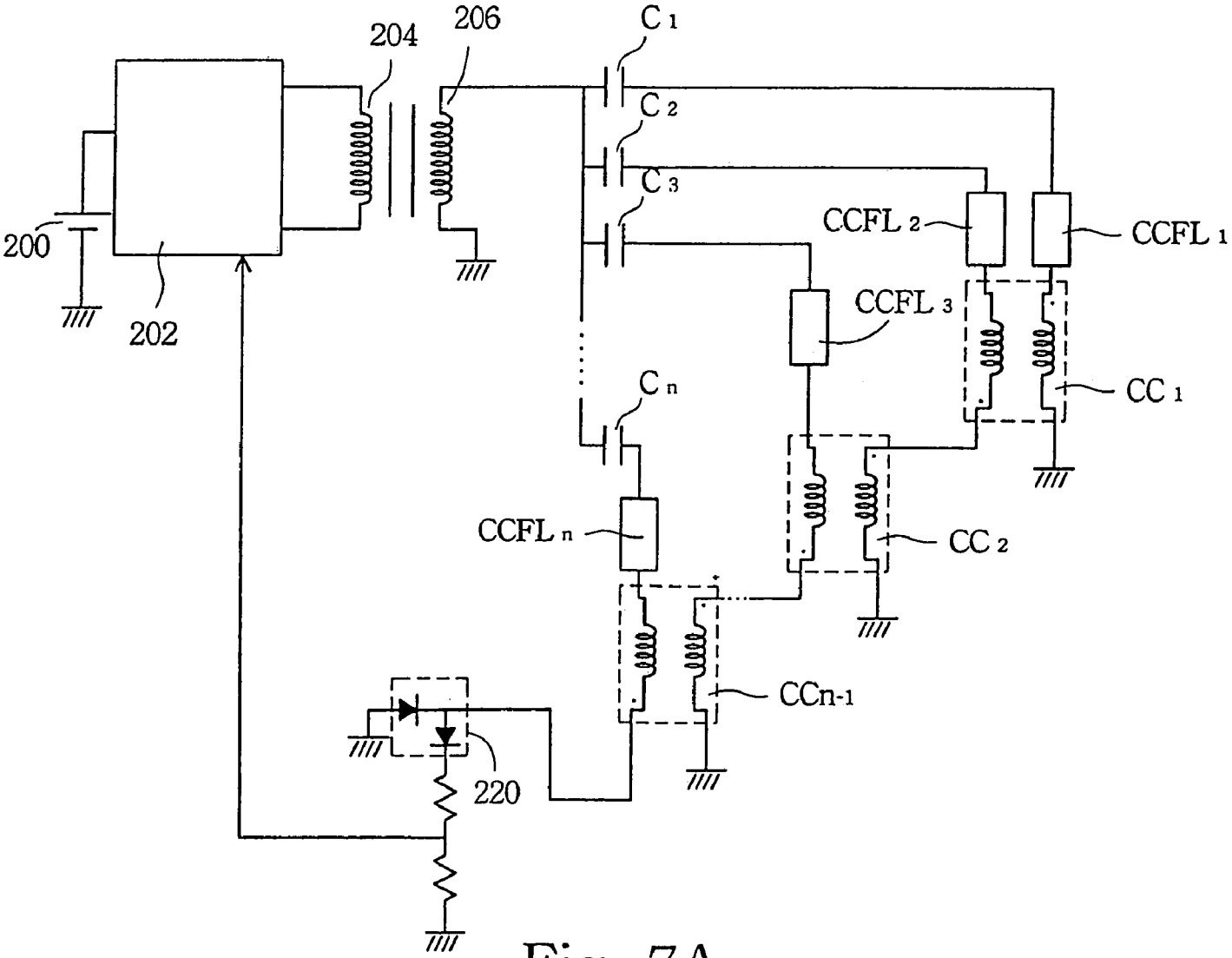
FIG. 7A is a schematic drawing of the DC/AC converter circuit structure of the first embodiment used to drive a plurality of cold cathode fluorescent lamps in accordance with the present invention.

FIG. 7A is a schematic drawing of the DC/AC converter circuit structure of the first embodiment used to drive a plurality of cold cathode fluorescent lamps in accordance with the present invention. DC power 200 provides DC power to the full bridge circuit 202. DC power 200 is connected to a primary winding 204 of a transformer through the full bridge circuit 202. The secondary winding 206 of a transformer is coupled to a plurality of high voltage capacitors $C_1$ to Cn. Each high voltage capacitor is connected to a corresponding cold cathode fluorescent lamp $CCFL_1$ to CCFLn. Any adjacent two cold cathode fluorescent lamps are connected to a common-mode choke. In other words, when applying the DC/AC converter circuit structure of the present invention to drive a plurality of cold cathode fluorescent lamps, the number of common-mode chokes used is less than the number of cold cathode fluorescent lamps driven by one. Therefore, the number of the used common-mode choke is (N−1) if the number of the driven cold cathode fluorescent lamps is N.

On the other hand, the common-mode choke $CC_1$ balances the current flowing through the cold cathode fluorescent lamp $CCFL_1$ and the current flowing through the cold cathode fluorescent lamp $CCFL_2$. The common-mode choke $CC_2$ balances the current flowing through the cold cathode fluorescent lamp $CCFL_2$ and the current flowing through the cold cathode fluorescent lamp $CCFL_3$ Similarly, the common-mode choke $CC_{n-1}$ balances the current flowing through the cold cathode fluorescent lamp $CCFL_{n-1}$, and the current flowing through the cold cathode fluorescent lamp $CCFL_n$. Therefore, the current flowing through the cold cathode fluorescent lamp $CCFL_1$ to CCFLn will be balanced by adding these common-mode chokes disclosed by the present invention to the DC/AC converter structure.

The output end of the common-mode choke $CC_{n-1}$ is connected to a dual diode 220 to feed back the current at the output end to the full bridge circuit 202. A half-bridge circuit, a push-pull circuit or a Royer circuit can be used to replace the full bridge circuit 202. The structure of the common-mode choke is similar to the structure of a transformer. The material of the common-mode choke 300 is MPP Powder Core, Micrometals Powdered Iron Core, Ferrite EE-core, Pot-Core or Toroid core.

Moreover, as shown in FIG. 7A, one of the two output ends of the any common-mode choke is grounded and the other output end is connected to one of the two output ends of the adjacent common-mode choke. For example, one of the two output ends of the common-mode choke $CC_M$ is grounded and the other output end of the common-mode choke $CC_M$ is connected to one of the two output ends of the adjacent common-mode choke $CC_{M-1}$, and M=2, 3, . . . N−1. It is noted that the grounded output ends of these common-mode chokes can also be connected together to connect to the dual diode 220 to feed back the current at the output ends to the full bridge circuit 202.

Figure 7B:
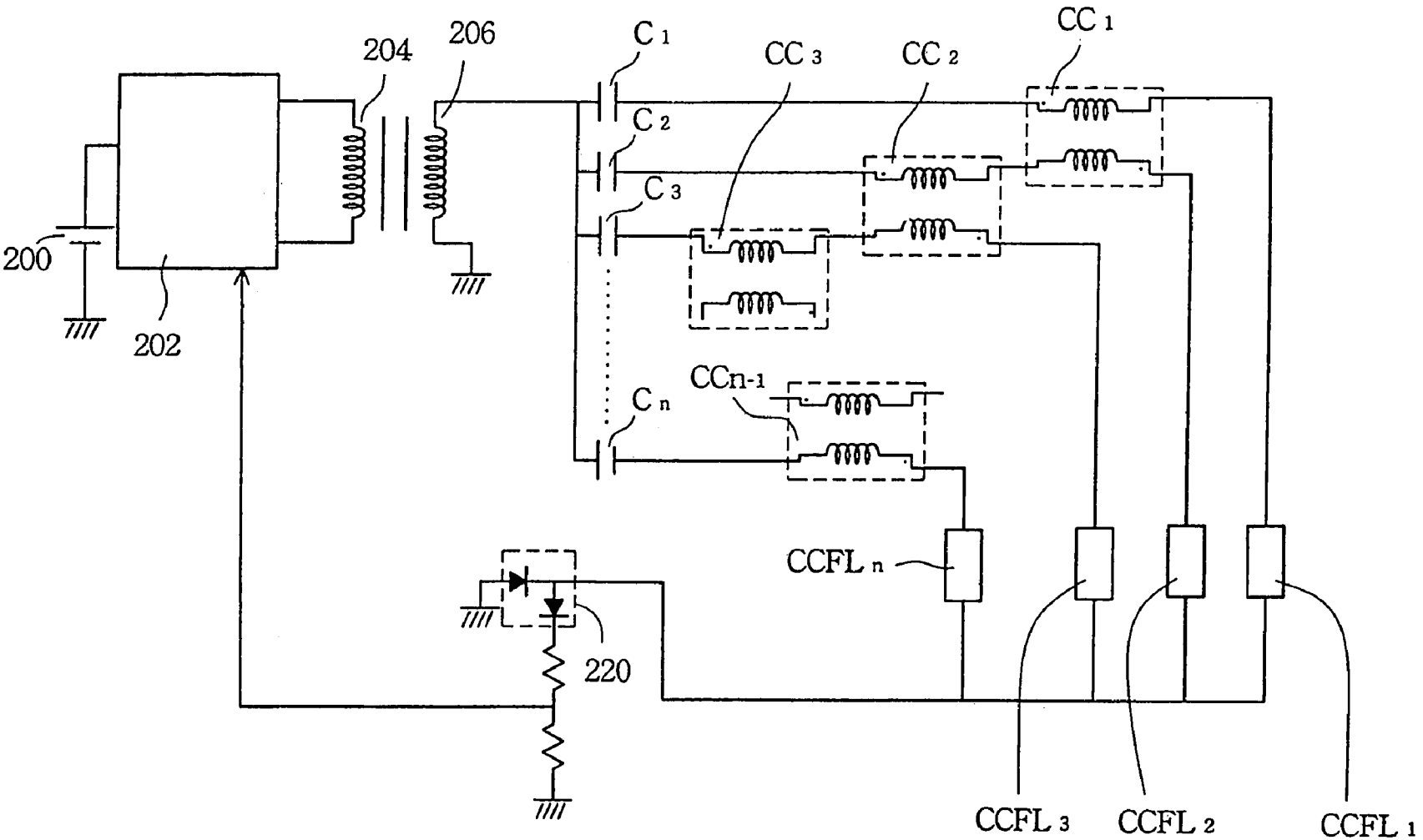
FIG. 7B is a schematic drawing of the DC/AC converter circuit structure of the second embodiment applied to drive a plurality of cold cathode fluorescent lamps in accordance with the present invention.

FIG. 7B is a schematic drawing of the DC/AC converter circuit structure of the second embodiment used to drive a plurality of cold cathode fluorescent lamps in accordance with the present invention. DC power 200 provides DC power to the full bridge circuit 202. DC power 200 is connected to a primary winding 204 of a transformer through the full bridge circuit 202. The secondary winding 206 of a transformer is coupled to a plurality of high voltage capacitors $C_1$ to Cn. Any adjacent two high voltage capacitors are respectively connected to the two input ends of a corresponding common-mode choke. The two output ends of each common-mode choke are respectively connected to the corresponding cold cathode fluorescent lamp $CCFL_1$ to CCFLn. In other words, when using the DC/AC converter circuit structure of the present invention to drive a plurality of cold cathode fluorescent lamps, the number of common-mode chokes used is less than the number of the driven cold cathode fluorescent lamps by one. Therefore, the number of the used common-mode choke is (N−1) if the number of the driven cold cathode fluorescent lamps is N.

On the other hand, the common-mode choke $CC_1$ balances the current flowing through the cold cathode fluorescent lamp $CCFL_1$ and the current flowing through the cold cathode fluorescent lamp $CCFL_2$. The common-mode choke $CC_2$ balances the current flowing through the cold cathode fluorescent lamp $CCFL_2$ and the current flowing through the cold cathode fluorescent lamp $CCFL_3$. Similarly, the common-mode choke $CC_{n-1}$ balances the current flowing through the cold cathode fluorescent lamp $CCFL_{n-1}$ and the current flowing through the cold cathode fluorescent lamp $CCFL_n$. Therefore, the current flowing through the cold cathode fluorescent lamp $CCFL_1$ to CCFLn will be balanced by adding these common-mode chokes disclosed by the present invention to the DC/AC converter structure.

The output end of the cold cathode fluorescent lamp CCFLn is connected to a dual diode 220 to feed back the current on the output end of the lamp CCFLn to the full bridge circuit 202. This feedback signal modifies the full bridge circuit 202 to output the required energy. A half-bridge circuit, a push-pull circuitor a Royer circuit can be used to replace the full bridge circuit 202. The structure of the common-mode choke is similar to the structure of a transformer. The material of the common-mode choke 300 is MPP Powder Core, Micrometals Powdered Iron Core, Ferrite EE-core, Pot-Core or Toroid core.

Moreover, as shown in FIG. 7B, the output end of cold cathode fluorescent lamps $CCFL_1$ to CCFLn are connected together to connect to the dual diode 220 to feed back the current on the output ends of these lamps to the full bridge circuit 202. It is noted in the structure where the cold cathode fluorescent lamp CCFLn is the only lamp connected to the dual diode 220 to feed back the current on the output end of the lamp CCFLn to the full bridge circuit 202. Simple structure as it is, it achieves the goal of the present invention. On the other hand, the output ends of the rest of cold cathode fluorescent lamps $CCFL_1$ to $CCFL_{n-1}$ are grounded.

Figure 8A:
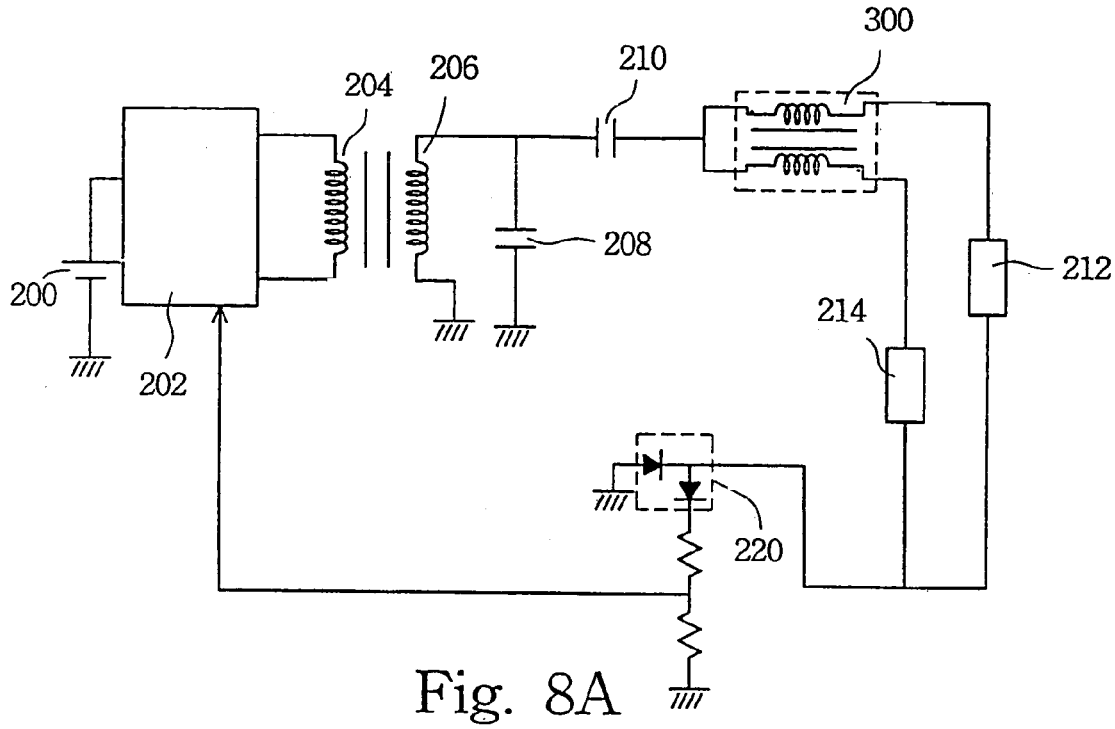
FIG. 8A is a schematic drawing of the common-mode choke applied in an DC/AC converter to drive two cold cathode fluorescent lamps in accordance with the third embodiment of the present invention.

FIG. 8A is a schematic drawing of the common-mode choke 300 applied in a DC/AC converter to drive two cold cathode fluorescent lamps in accordance with the third embodiment of the present invention. DC power 200 provides DC power to the full bridge circuit 202. DC power 200 is connected to a primary winding 204 of a transformer through the full bridge circuit 202. The secondary winding 206 of a transformer is coupled to the two high voltage capacitors 208 and 210, in which the high voltage capacitor 210 is coupled with the common-mode choke 300 of the present invention. The two output ends of the common-mode choke 300 are connected to the two cold cathode fluorescent lamps 212 and 214 respectively. The cold cathode fluorescent lamp 214 is connected to the first winding and the cold cathode fluorescent lamp 212 is connected to the second winding. The output ends of the two cold cathode fluorescent lamps 212 and 214 are connected together and connected to a dual diode 220 to feed back the currents on the output end of the cold cathode fluorescent lamp 212 and 214 to the full bridge circuit 202. A half-bridge circuit, a push-pull circuit or a Royer circuit can be used to replace the full bridge circuit 202. The structure of the common-mode choke is similar to the structure of a transformer. On the other hand, the material of the common-mode choke 300 is MPP Powder Core, Micrometals Powdered Iron Core, Ferrite EE-core, Pot-Core or Toroid core. The main difference between the third embodiment and the second embodiment is that only common-mode choke 300 is coupled with one high voltage capacitor 210.

Figure 8B:
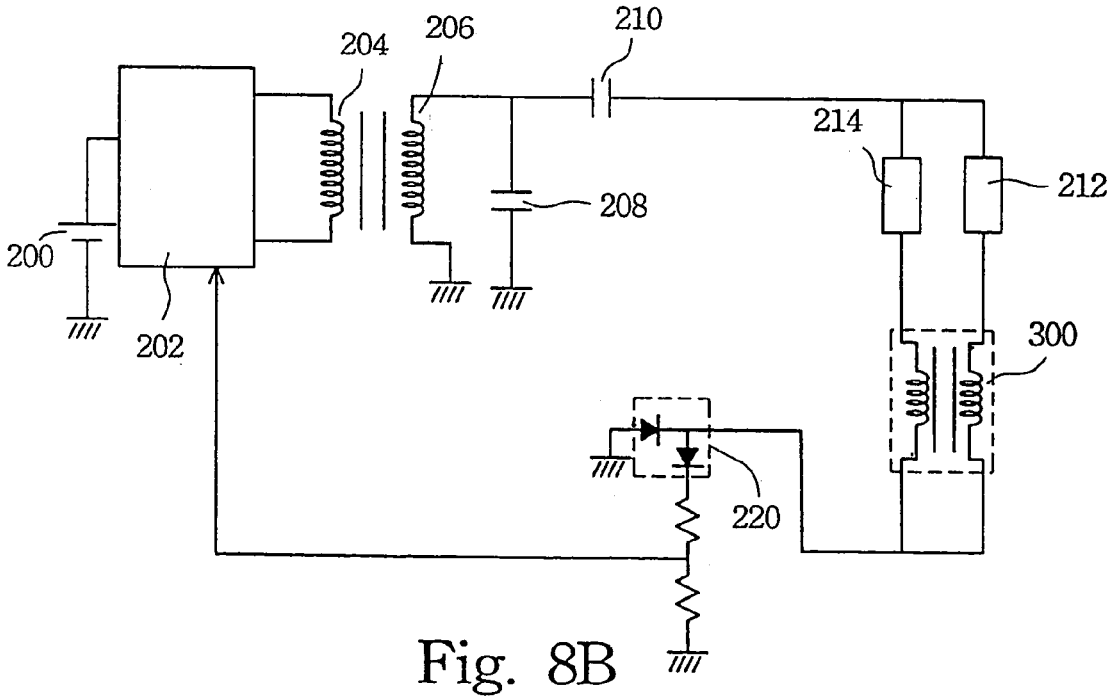
FIG. 8B is a schematic drawing of the common-mode choke applied in an AC/DC converter to drive two cold cathode fluorescent lamps in accordance with the fourth embodiment of the present invention.

FIG. 8B is a schematic drawing of the common-mode choke 300 applied in an DC/AC converter to drive two cold cathode fluorescent lamps in accordance with the fourth embodiment of the present invention. A DC power 200 provides a DC power to the full bridge circuit 202. This DC power 200 is connected to a primary winding 204 of a transformer through the full bridge circuit 202. The secondary winding 206 of a transformer is coupled to two high voltage capacitors 208 and 210, wherein the high voltage capacitor 210 is connected to the input ends of the two cold cathode fluorescent lamps 212 and 214. The output ends of the two cold cathode fluorescent lamps 212 and 214 are respectively connected to the first winding and the second winding of the common-mode choke 300 of the present invention. The cold cathode fluorescent lamp 214 is connected to the first winding and the cold cathode fluorescent lamp 212 is connected to the second winding. One of the output ends of the common-mode choke 300 is connected to a dual diode 220 to feed back the current on the output end to the full bridge circuit 202. A half-bridge circuit, a push-pull circuit or a Royer circuit can be used to replace the full bridge circuit 202. The structure of the common-mode choke is similar to the structure of a transformer. On the other hand, the material of the common-mode choke 300 is MPP Powder Core, Micrometals Powdered Iron Core, Ferrite EE-core, Pot-Core or Toroid core. The main difference between the first embodiment and the fourth embodiment is that only the common-mode choke 300 is coupled with one high voltage capacitor 210.

Similarly to the first and second embodiments, the common-mode choke 300 of the third and fourth embodiments of the present invention can be located on the high voltage side or the low voltage side of the cold cathode fluorescent lamp. The common-mode choke 300 balances the current flowing through the first winding $N_1$ and the current flowing through the second winding $N_2$ by the design of the common-mode choke 300.

Figure 8C:
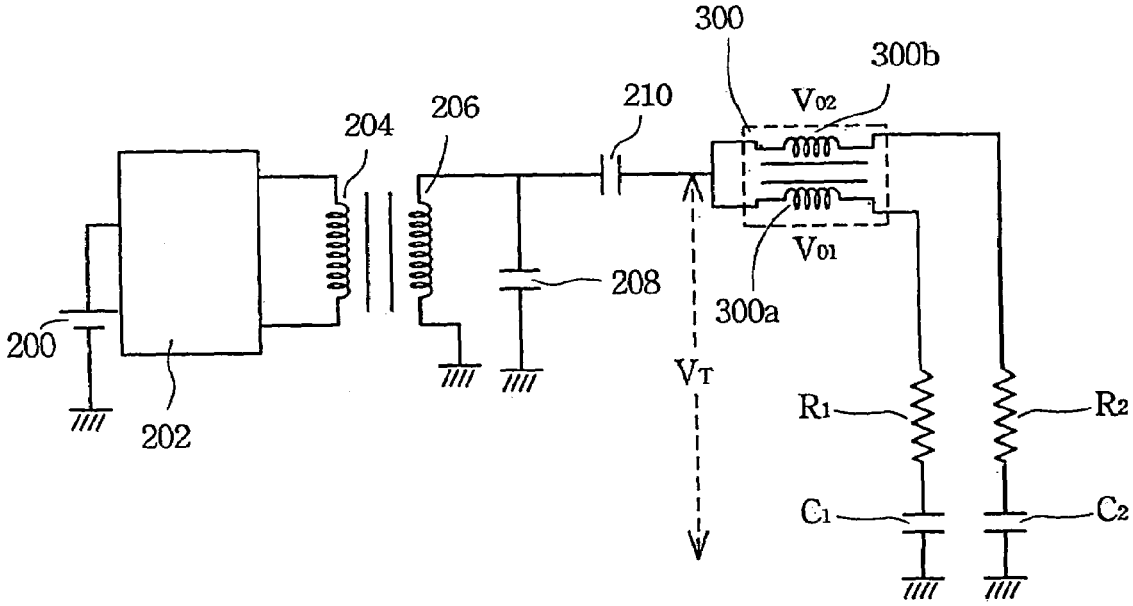
FIG. 8C is a schematic drawing of the circuit structure of the third embodiment used to calculate the inductance of the common-mode choke in accordance with the present invention.

The inductance in the common-mode choke 300 used in the FIG. 8A can be calculated by the method described in the following. When calculating, one resistor and one capacitor in parallel are first used to replace the cold cathode fluorescent lamp because the cold cathode fluorescent lamp possesses the negative resistance characteristics and the parasitic capacitance of the cold cathode fluorescent are included. Next, the one resistor and one capacitor are changed from in parallel to in series, as shown in the FIG. 8C. The two groups ($R_1$, $C_1$) and ($R_2$, $C_2$), each group composed of one resistor and one capacitor in series, are respectively used to replace the two cold cathode fluorescent lamps 212 and 214 the FIG. 8C. Therefore, in accordance with FIG. 8C, the voltage difference between the input end and the output end of the cold cathode fluorescent lamp 214 is ($V_{R1}$+$V_{C1}$). The voltage difference between the input end and the output end of the cold cathode fluorescent lamp 212 is ($V_{R2}$+$V_{C2}$). The end voltage of the first winding 300*a* of the common-mode choke 300 is $V_{O1}$. The end voltage of the second winding 300*b* of the common-mode choke 300 is $V_{O2}$. The following equations are obtained in accordance with Kirchhoff's Voltage Law:

$$V_T=V_{O1}+V_{R1}+V_{C1} \tag{4}$$

$$V_T=-V_{O2}+V_{R2}+V_{C2} \tag{5}$$

$V_T$ is the voltage between the capacitor 210 and the common-mode choke 300.

Next, the impedance of the capacitor will be expressed in the complex domain for calculations. The current flowing through the first winding 300*a* of the common-mode choke 300 is $I_1$. The current flowing through the second winding 300*b* of the common-mode choke 300 is $I_2$. Then, equations (4) and (5) yield in:

$$V_T=V_{O1}+I_1\times R_1+I_1\times(1/j\omega C_1) \tag{6}$$

$$V_T=-V_{O2}+I_2\times R_2+I_2\times(1/j\omega C_2) \tag{7}$$

The current $I_1$ flowing through the first winding 300*a* and the current $I_2$ flowing through the second winding 300*b* are equal. The inductance of both the first winding 300*a* and the second winding 300*b* of the common-mode choke 300 is L. The coupling coefficient of the common-mode choke 300 is K. Then, the following equation is obtained from equations (6) and (7)

$$L=\frac{1}{1(1-K)}\left[\frac{(R_1^2-R_2^2)}{1/C_1+1/C_2}+\frac{1}{\omega^2}\left(\frac{1}{C_1}-\frac{1}{C_2}\right)\right] \tag{8}$$

Therefore, the inductance of the common-mode choke can be obtained from equation (8). For example, the inductance of both the first winding 300*a* and the second winding 300*b* of the common-mode choke 300 are 650 mH when resistor $R_1$ has a resistance of 120 K ohm, resistor $R_2$ has a resistance of 90 K ohm, the coupling coefficient of the common-mode choke is 0.85 and the frequency is selected 50 KHz.

Figure 9:
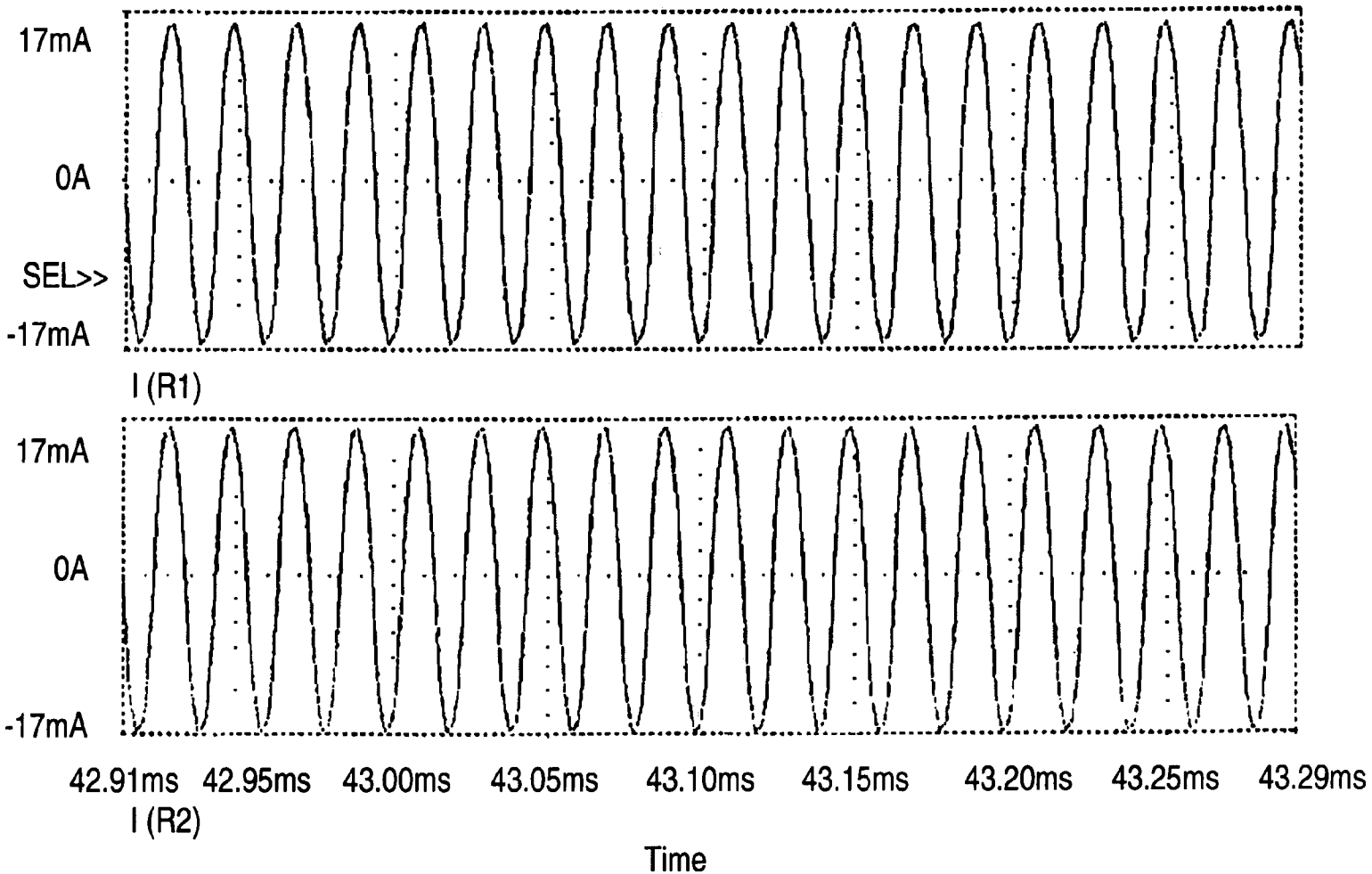
FIG. 9 is a schematic drawing comparing the current flowing through the two cold cathode fluorescent lamps when applying the DC/AC converter to drive two cold cathode fluorescent lamps in accordance with the third embodiment of the present invention.

FIG. 9 is a drawing comparing the current flowing through the two cold cathode fluorescent lamps when the DC/AC converter is used to drive two cold cathode fluorescent lamps in accordance with the third embodiment of the present invention. In accordance with the comparison drawing, the current flowing through the two cold cathode fluorescent lamps are almost equal. Obviously, the circuit structure of the present invention balances the current flowing through the two cold cathode fluorescent lamps respectively.

Figure 10A:
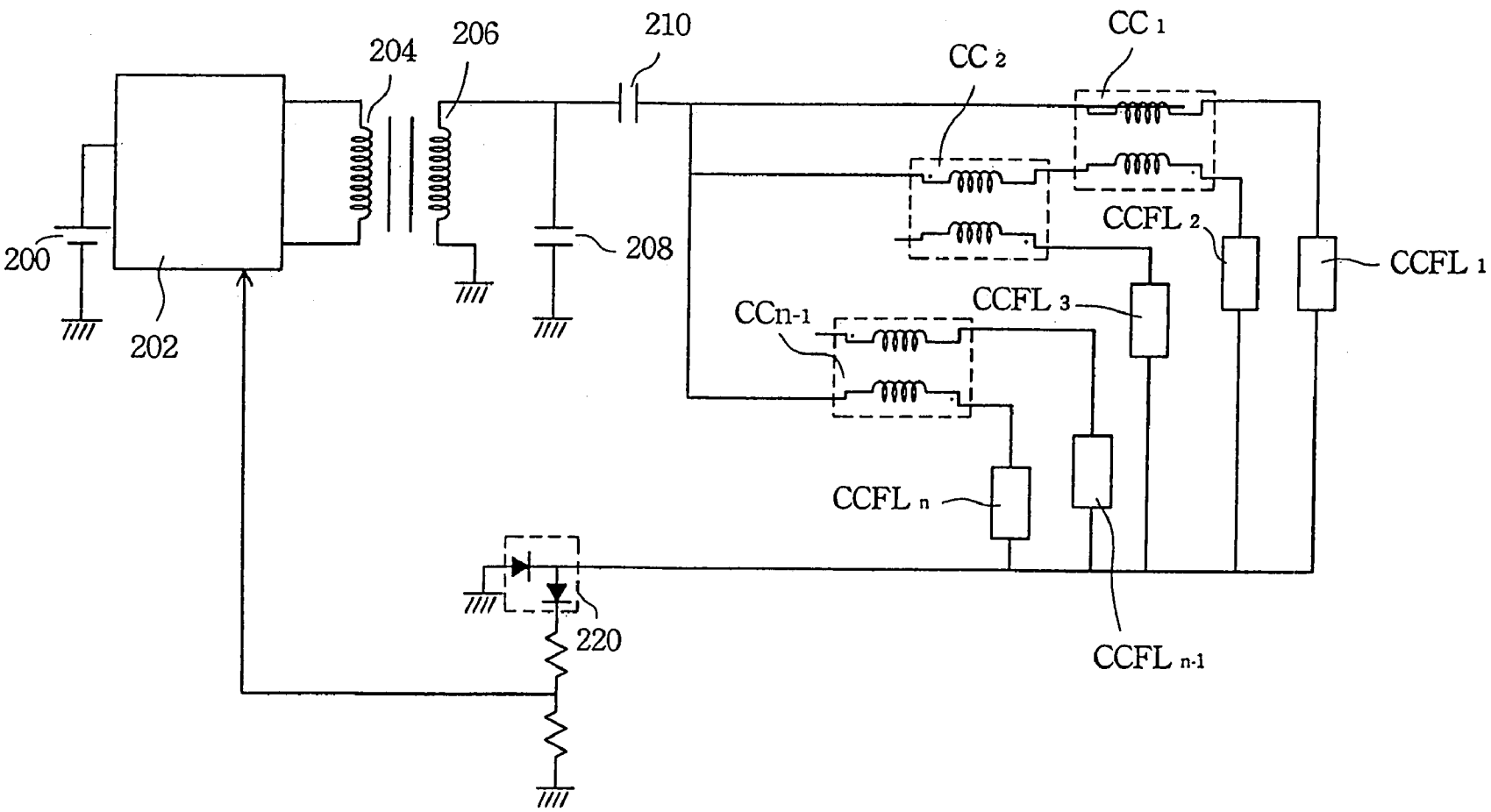
FIG. 10A is a schematic drawing of the DC/AC converter circuit structure of the third embodiment to drive a plurality of cold cathode fluorescent lamps in accordance with the present invention.

FIG. 10A is a schematic drawing of the DC/AC converter circuit structure of the third embodiment used to drive a plurality of cold cathode fluorescent lamps in accordance with the present invention. A DC power 200 provides a DC power to the full bridge circuit 202. This DC power 200 is connected to a primary winding 204 of a transformer through the full bridge circuit 202. The secondary winding 206 of a transformer is coupled to two high voltage capacitors 208 and 210. The high voltage capacitor 210 is connected to a plurality of common-mode chokes $CC_1$ to CCn. The output ends of each common-mode choke is coupled with the corresponding cold cathode fluorescent lamps $CCFL_1$ to CCFLn. In other words, when the DC/AC converter circuit structure of the present invention is used to drive a plurality of cold cathode fluorescent lamps, the number of the common-mode chokes used is less than the number of the driven cold cathode fluorescent lamps by one. Therefore, the number of common-mode chokes used is (N−1) if the number of the driven cold cathode fluorescent lamps is N.

On the other hand, the common-mode choke $CC_1$ balances the current flowing through the cold cathode fluorescent lamp $CCFL_1$ and the current flowing through the cold cathode fluorescent lamp $CCFL_2$. The common-mode choke $CC_2$ balances the current flowing through the cold cathode fluorescent lamp $CCFL_2$ and the current flowing through the cold cathode fluorescent lamp $CCFL_3$. The rest can be deduced by analogy. The common-mode choke $CC_{n-1}$ balances the current flowing through the cold cathode fluorescent lamp $CCFL_{n-1}$ and the current flowing through the cold cathode fluorescent lamp $CCFL_n$. Therefore, these currents respectively flowing through the cold cathode fluorescent lamp $CCFL_1$ to CCFLn are balanced by adding these common-mode chokes disclosed by the present invention to the DC/AC converter structure.

The output ends of the cold cathode fluorescent lamps $CCFL_1$ to CCFLn are connected to a dual diode 220 to feed back the current on the output ends of the lamps to the full bridge circuit 202. A half-bridge circuit, a push-pull circuit or a Royer circuit can be used to replace the full bridge circuit 202. The structure of the common-mode choke is similar to the structure of a transformer. On the other hand, the material of the common-mode choke 300 is MPP Powder Core, Micrometals Powdered Iron Core, Ferrite EE-core, Pot-Core or Toroid core.

Moreover, as shown in FIG. 10A, the output end of theses cold cathode fluorescent lamp $CCFL_1$ to CCFLn are connected together to connect to the dual diode 220 to feed back the current on the output ends of these lamps to the full bridge circuit 202. In the structure, here the cold cathode fluorescent lamp CCFLn is the only lamp connected to the dual diode 220 to feed back the current at the output end of the lamp CCFLn of the full bridge circuit 202. It also satisfies the goals of the present invention. On the other hand, the output ends of the rest cold cathode fluorescent lamps $CCFL_1$ to $CCFL_{n-1}$, are grounded.

Figure 10B:
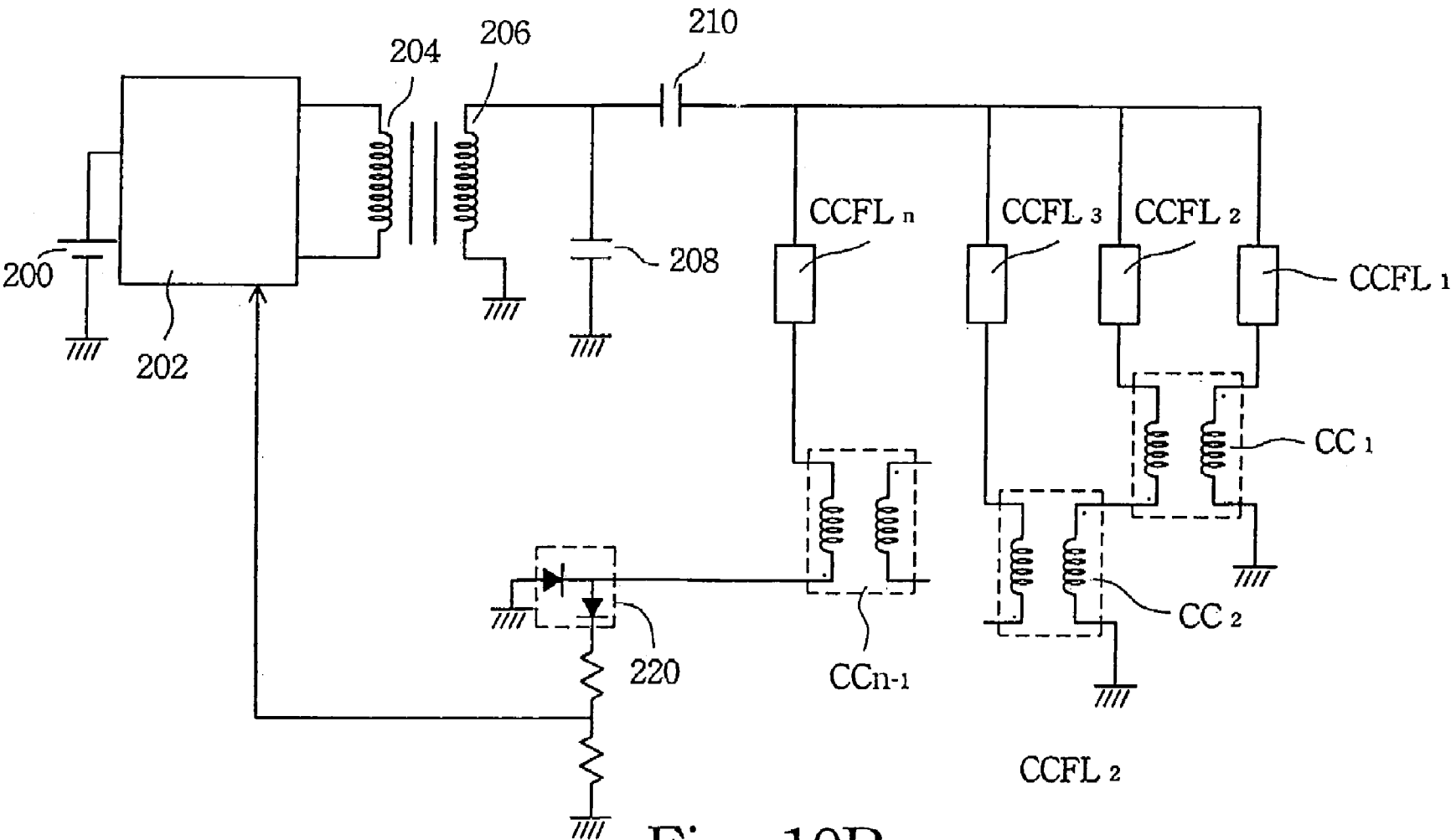
FIG. 10B is a schematic drawing of the DC/AC converter circuit structure of the fourth embodiment used to drive a plurality of cold cathode fluorescent lamps in accordance with the present invention.

FIG. 10B is a schematic drawing of the DC/AC converter circuit structure of the fourth embodiment used to drive a plurality of cold cathode fluorescent lamps in accordance with the present invention. DC power 200 provides DC power to the full bridge circuit 202. DC power 200 is connected to a primary winding 204 of a transformer through the full bridge circuit 202. The secondary winding 206 of a transformer is coupled to two high voltage capacitors 208 and 210. The high voltage capacitor 210 is connected to a plurality of the cold cathode fluorescent lamp $CCFL_1$ to CCFLn. Any adjacent two cold cathode fluorescent lamps are connected to a corresponding common-mode choke $CC_1$ to CCn. In other words, when the DC/AC converter circuit structure of the present invention is used to drive a plurality of cold cathode fluorescent lamps, the number of used common-mode chokes used is less than the number of the driven cold cathode fluorescent lamps by one. Therefore, the number of common-mode chokes used is (N−1) if the number of the driven cold cathode fluorescent lamps is N.

On the other hand, the common-mode choke $CC_1$ balances the current flowing through the cold cathode fluorescent lamp $CCFL_1$ and the current flowing through the cold cathode fluorescent lamp $CCFL_2$. The common-mode choke $CC_2$ balances the current flowing through the cold cathode fluorescent lamp $CCFL_2$ and the current flowing through the cold cathode fluorescent lamp $CCFL_3$. Similarly, the common-mode choke $CC_{n-1}$ balances the current flowing through the cold cathode fluorescent lamp $CCFL_{n-1}$ and the current flowing through the cold cathode fluorescent lamp $CCFL_n$. Therefore, the current flowing through the cold cathode fluorescent lamp $CCFL_1$ to CCFLn are balanced by adding these common-mode chokes disclosed by the present invention to the DC/AC converter structure.

The output end of the common-mode choke $CC_{n-1}$ is connected to a dual diode 220 to feed back the current at the output end to the full bridge circuit 202. A half-bridge circuit, a push-pull circuit or a Royer circuit can be used to replace the full bridge circuit 202. The structure of the common-mode choke is similar to the structure of a transformer. On the other hand, the material of the common-mode choke 300 is MPP Powder Core, Micrometals Powdered Iron Core, Ferrite EE-core, Pot-Core or Toroid core.

Moreover, as shown in the FIG. 10B, one of the two output ends of the any common-mode choke is grounded and the other output end is connected to one of the two output ends of the adjacent common-mode choke. For example, one of the two output ends of the common-mode choke $CC_M$ is grounded and the other output end of the common-mode choke $CC_M$ is connected to one of the two output ends of the adjacent common-mode choke $CC_{M-1}$ and M=2, 3, . . . N−1. It is noted that the grounded output ends of these common-mode chokes can also be connected together to connect to the dual diode 220 to feed back the current on the output ends to the full bridge circuit 202.

FIGS. 11A to 11D are measurement rawings of the currents at the output ends of the common-mode choke 300 in the FIG. 5B in accordance with the present invention. The current flowing through the first winding is $I_{O1}$. The current flowing through the second winding is $I_{O2}$. The test conditions and the test result are shown as follows.

Test conditions:

Ambient temperature: 25° C.

Current probe: Tektronix P6022, S/N: 011-0161-00

Power supply: GW GPC-3030D

Multi-meter: HP 34401A

Figure 11A:
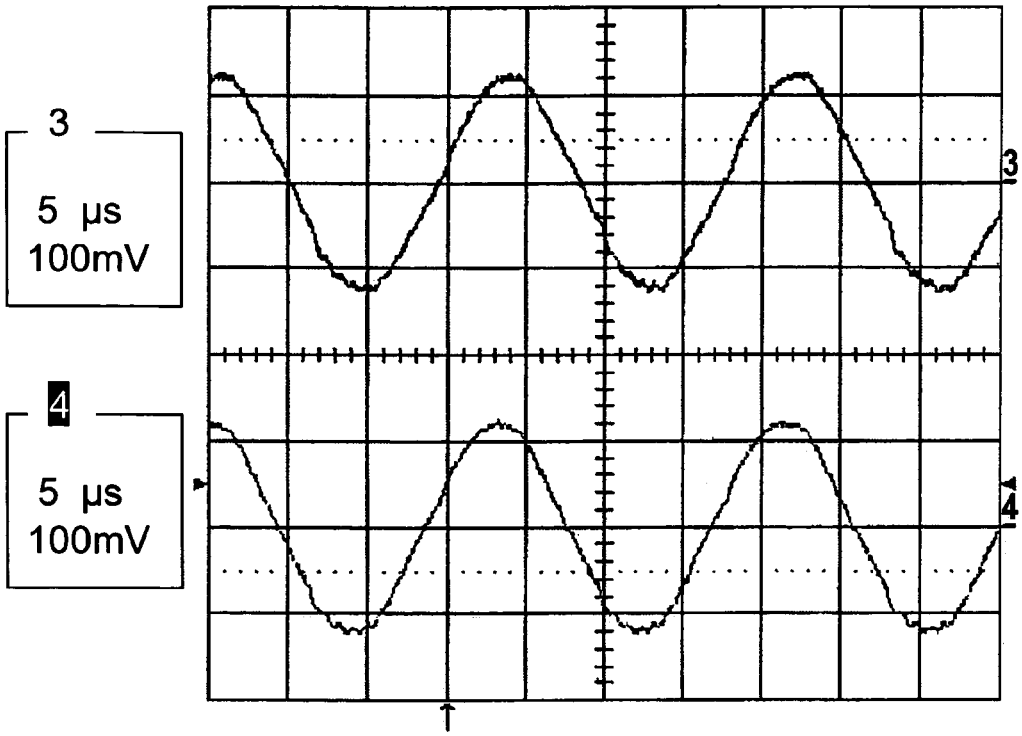
FIG. 11A to FIG. 11D respectively are schematic drawings of measurements of the current at the output of the common-mode choke in the FIG. 5B in accordance with the present invention.
Figure 11B:
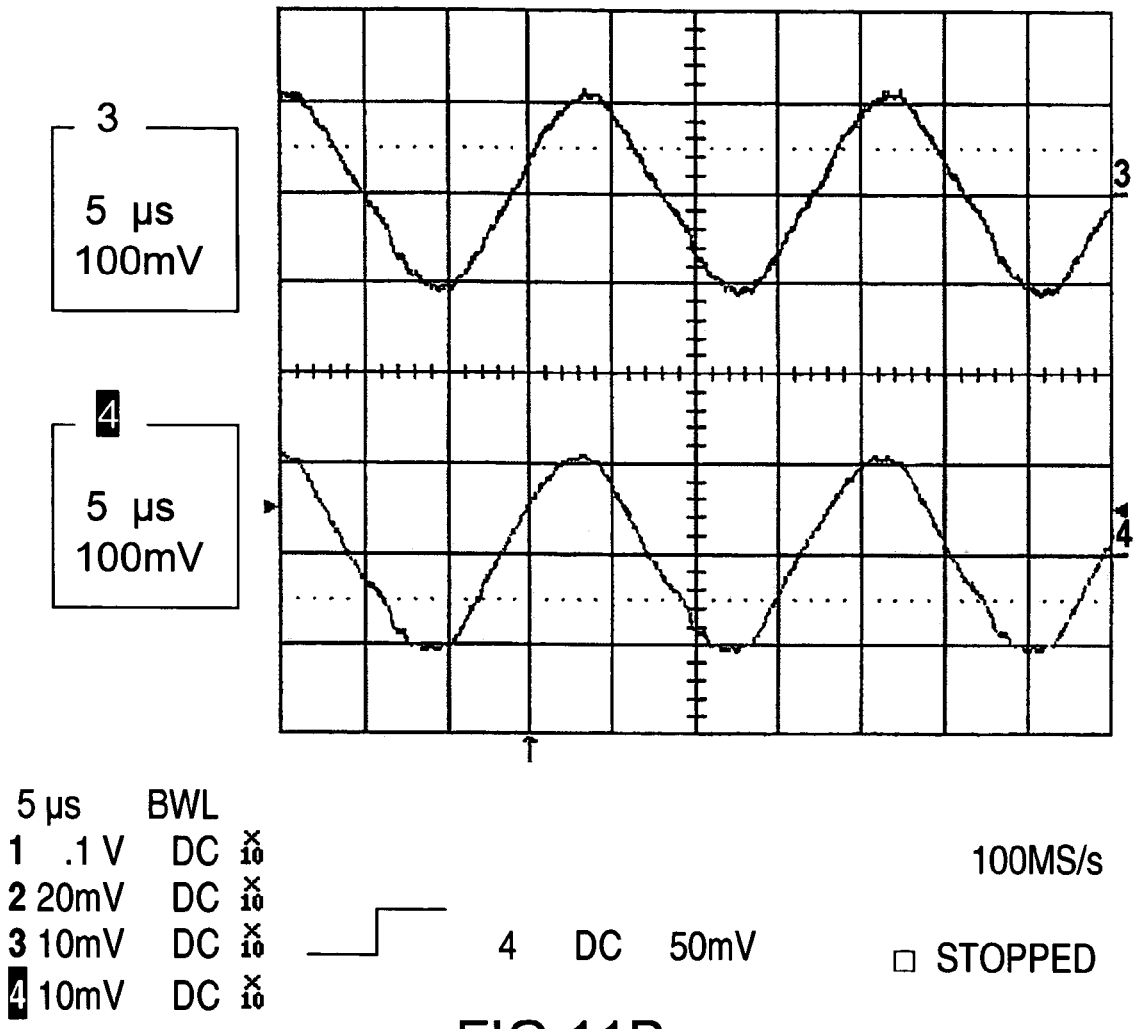
Figure 11C:
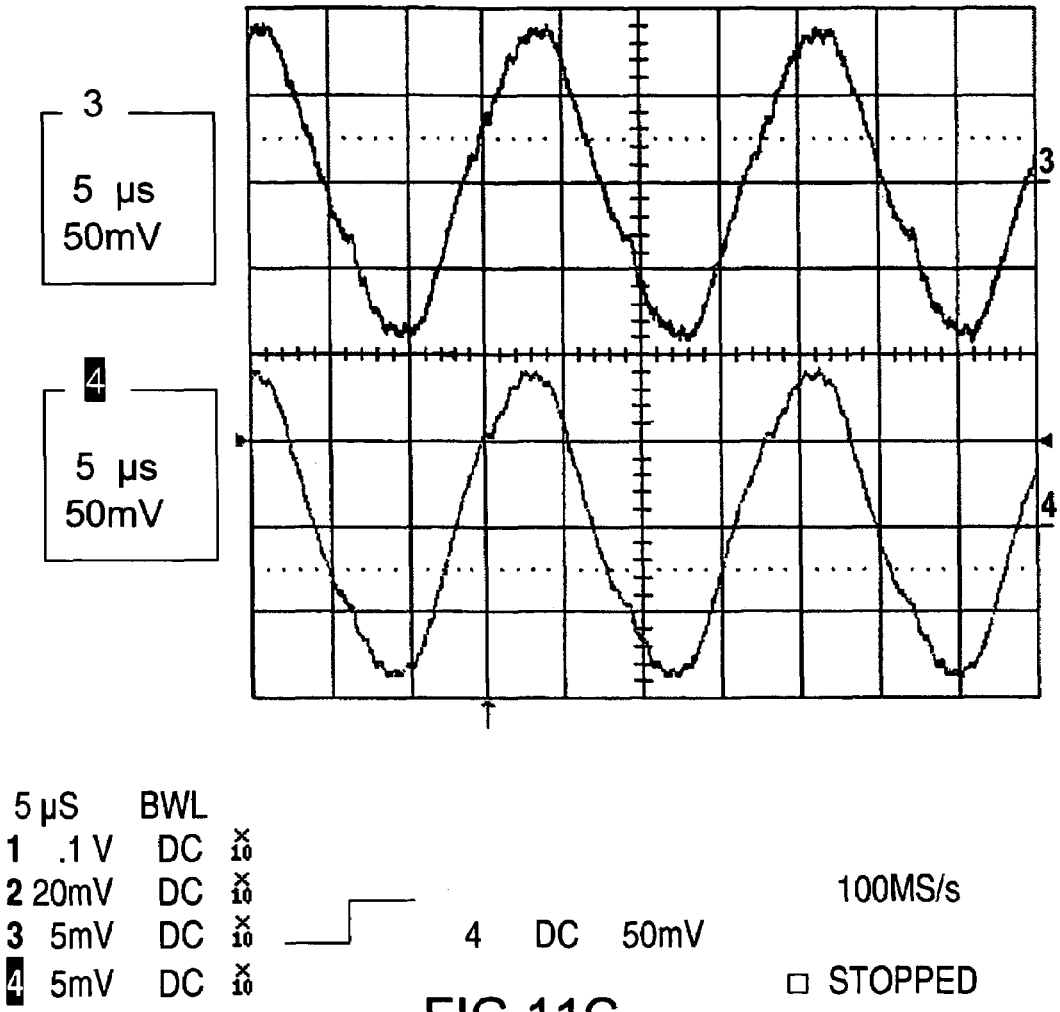
Figure 11D:
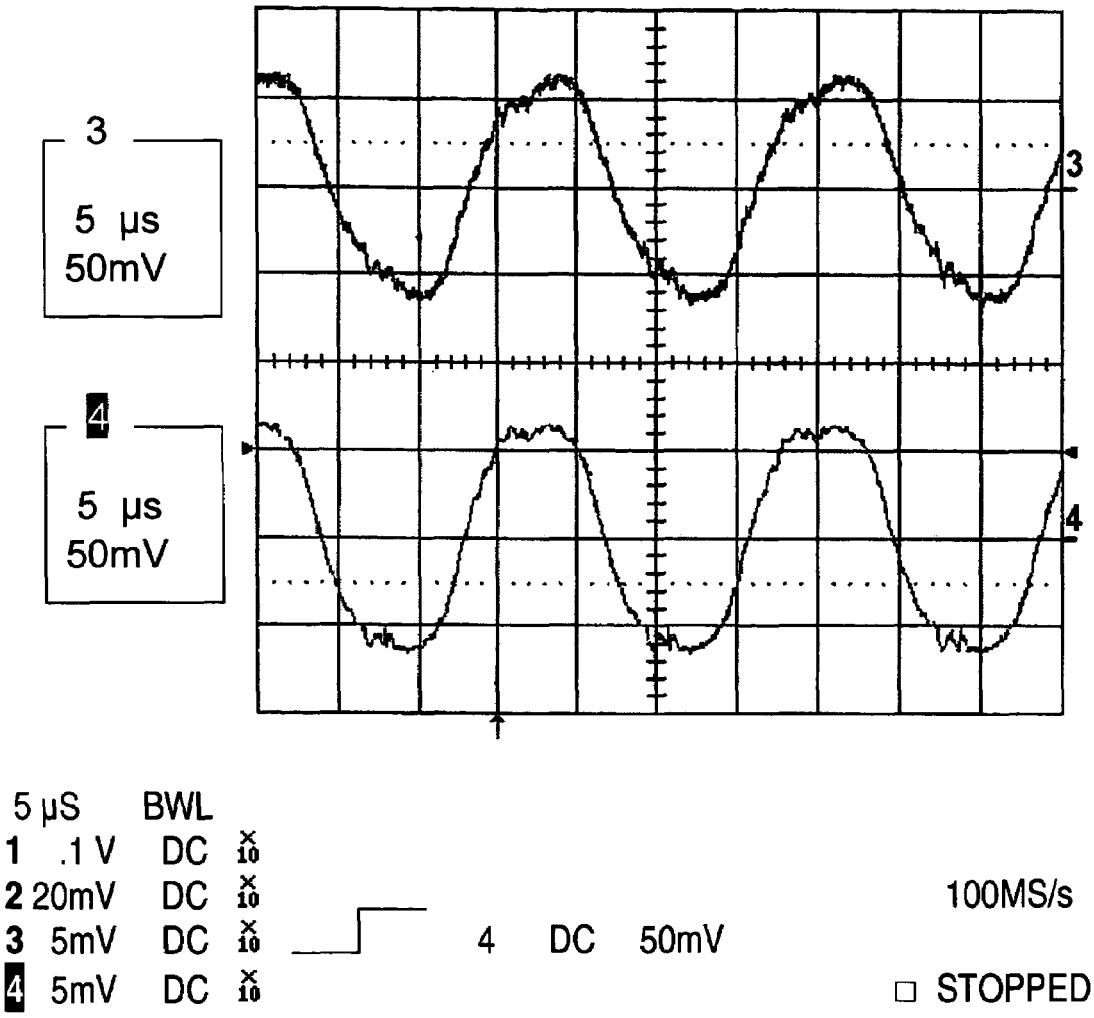

Test result:

| $I_{01}$ | $I_{02}$ | Diff. between $I_{01}$ and $I_{02}$ | |
|---|---|---|---|
| 8.15 mA | 8.11 mA | 0.04 mA | FIG. 11A |
| 6.80 mA | 6.86 mA | 0.06 mA | FIG. 11B |
| 5.60 mA | 5.53 mA | 0.07 mA | FIG. 11C |
| 3.91 mA | 3.88 mA | 0.03 mA | FIG. 11D |

From the above table, the differential between the current $I_{O1}$ flowing through the first winding and the current $I_{O2}$ flowing through the second winding is very small.

FIGS. 11E to 11H are measurement drawings when comparing the frequency and the currents on the output ends of the common-mode choke 300 in FIG. 5B in accordance with the present invention. The current flowing through the first winding is $I_{O1}$. The current flowing through the second winding is $I_{O2}$. The test results are shown as follows.

Figure 11E:
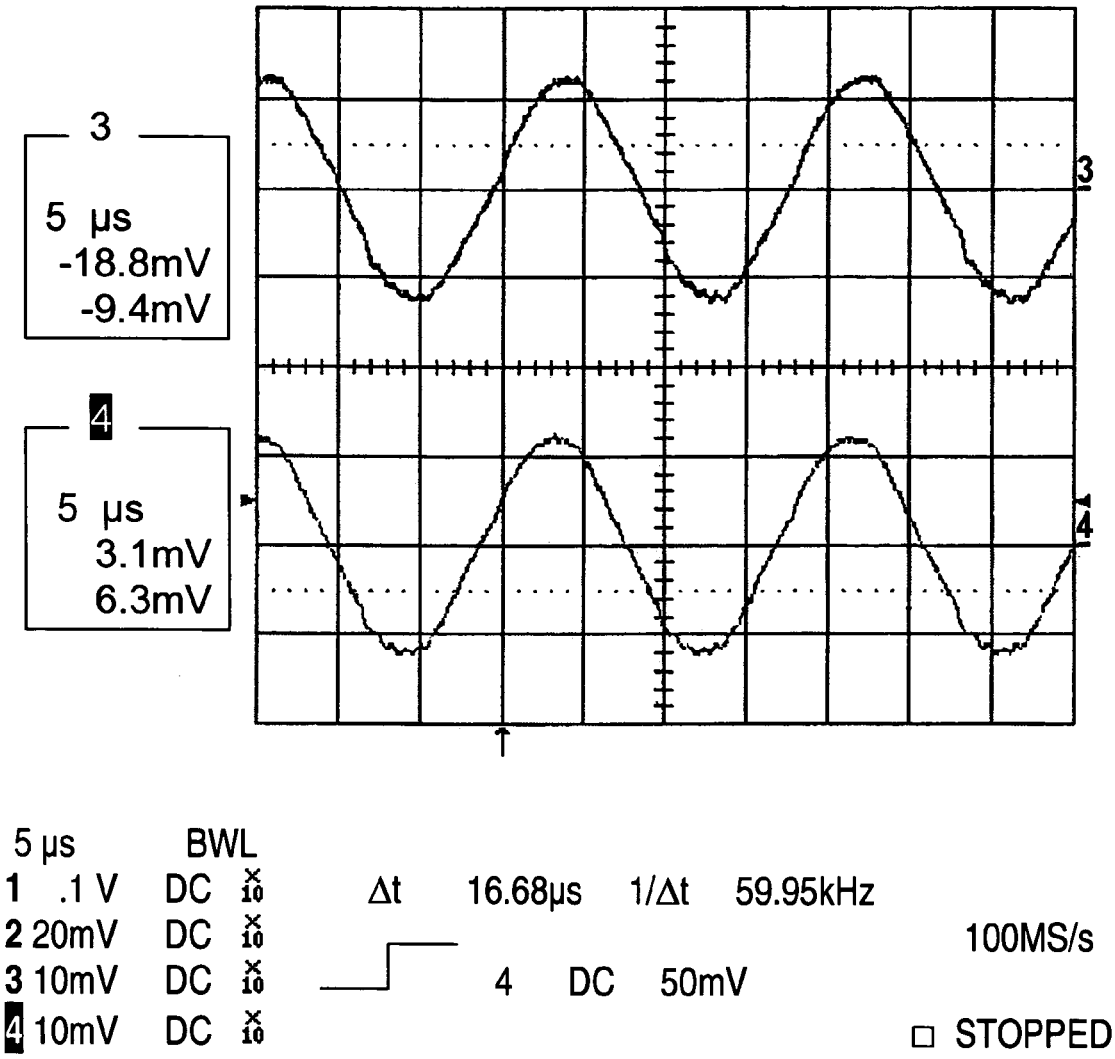
FIG. 11E to FIG. 11H are schematic drawings for comparing the frequency and the current at the output of the common-mode choke in the FIG. 5B in accordance with the present invention.
Figure 11F:
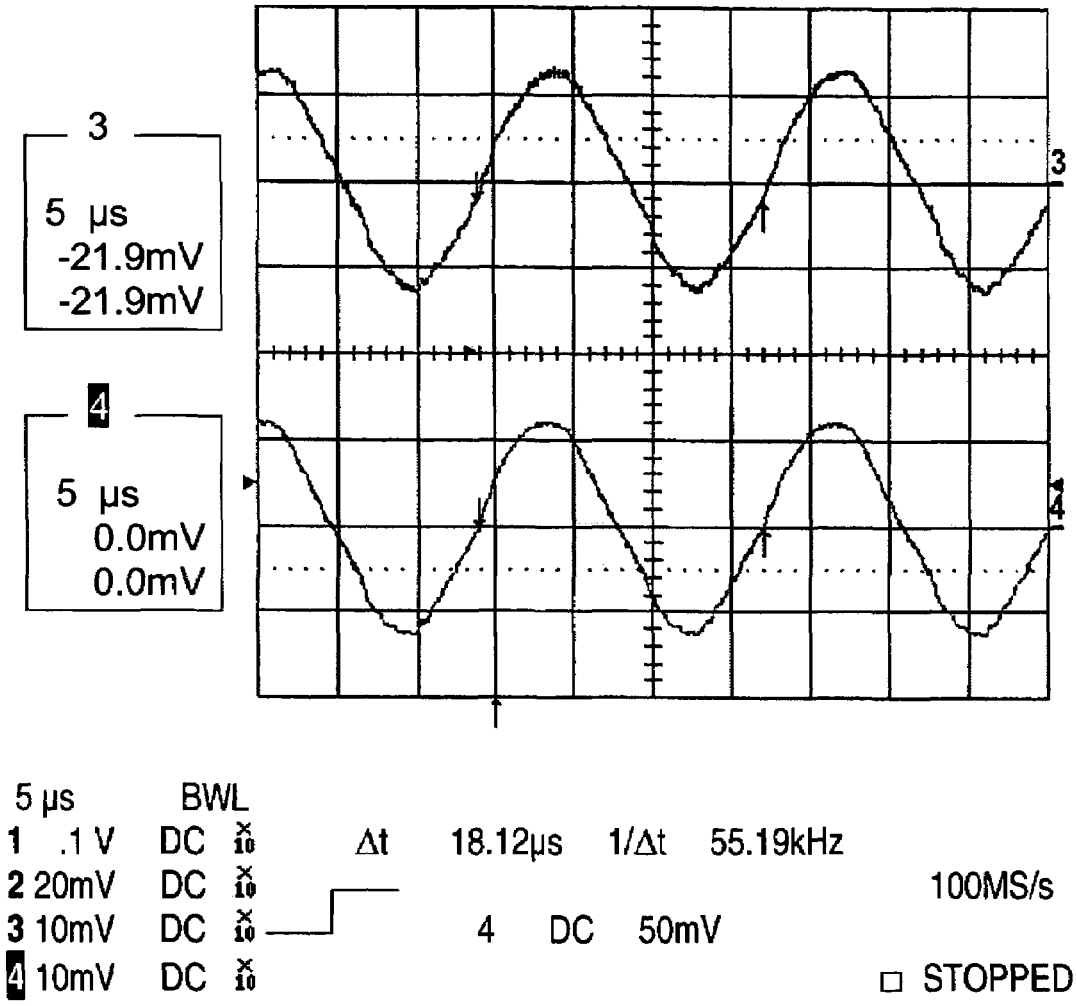
Figure 11G:
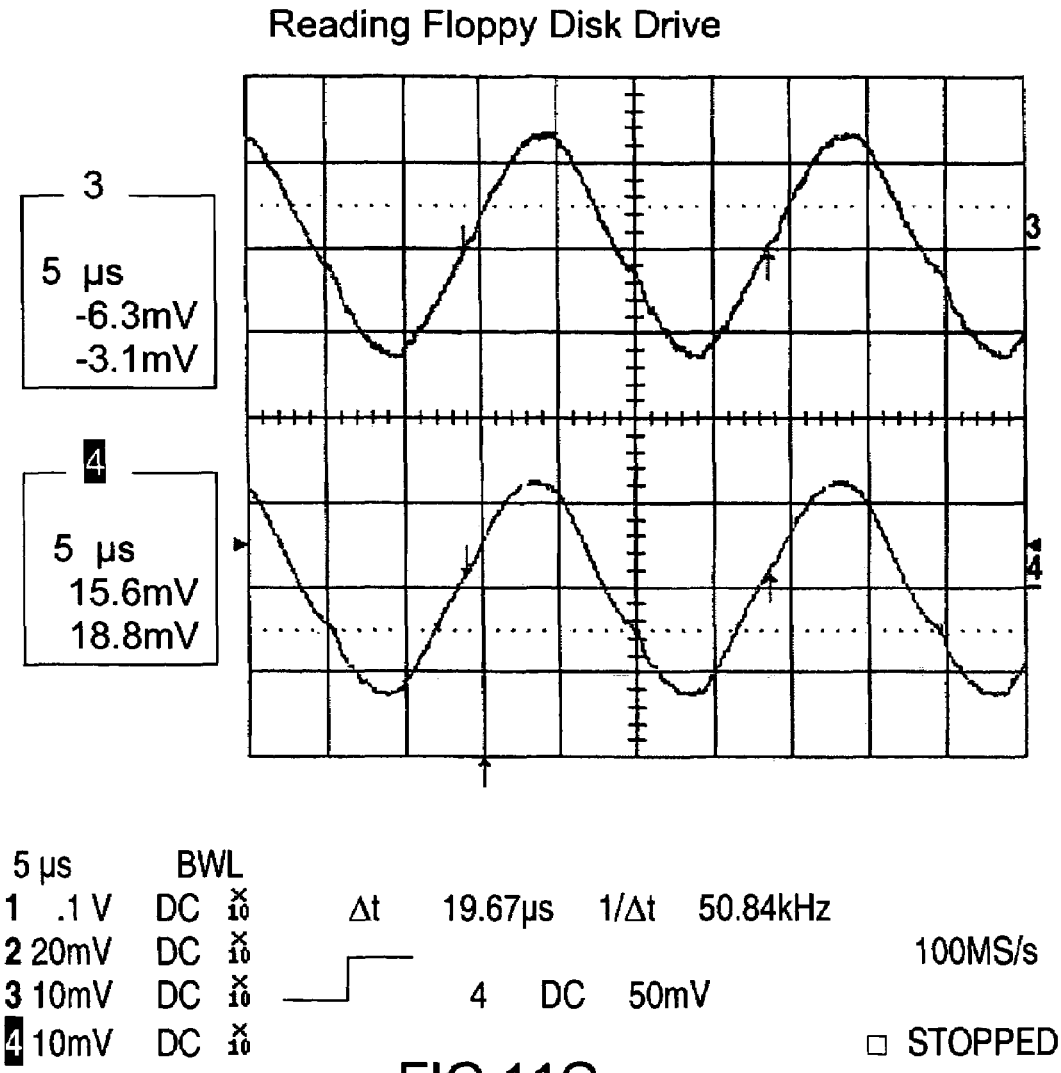
Figure 11H:
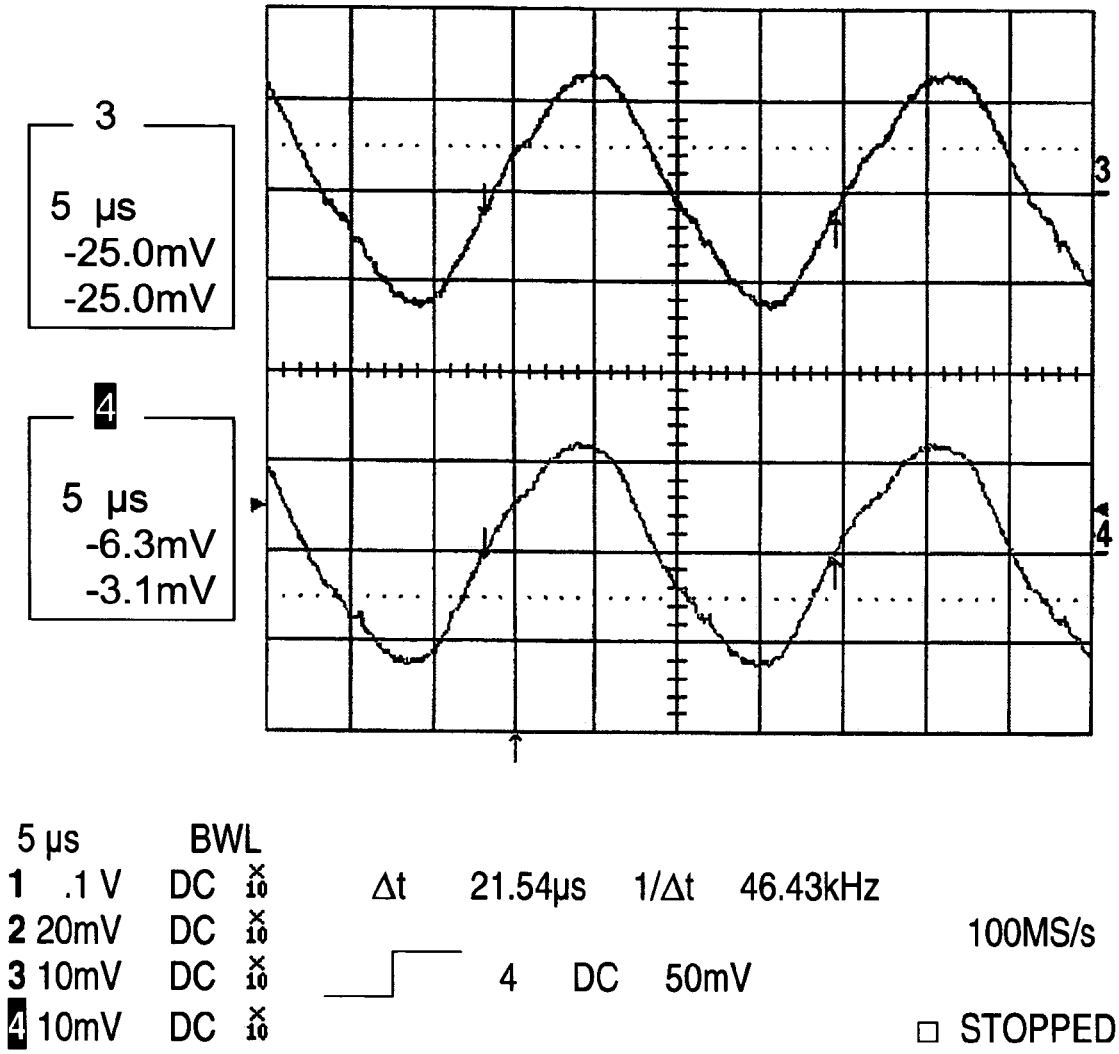

Test result:

| Frequency | $I_{01}$ | $I_{02}$ | |
|---|---|---|---|
| 60 Khz | 8.13 mA | 8.10 mA | FIG. 11E |
| 55 Khz | 8.14 mA | 8.10 mA | FIG. 11F |
| 50 Khz | 8.12 mA | 8.10 mA | FIG. 11G |
| 47 Khz | 8.14 mA | 8.10 mA | FIG. 11H |

From the above table, the frequency does not affect currents $I_{O1}$ and $I_{O2}$.

In accordance with the foregoing description and the test result, the circuit structure of the present invention provides the following advantages. First, this circuit structure balances the currents flowing through the multiple cold cathode fluorescent lamps when using a transformer to drive a plurality of cold cathode fluorescent lamps. On the other hand, the number and the structure of the cold cathode fluorescent lamps do not affect the balance of the current in accordance with the present invention. Second, this circuit structure does not require a plurality of transformers when driving a plurality of cold cathode fluorescent lamps. It reduces the number of components. Therefore, this circuit structure is smaller in size and lower in cost.

As is understood by a person skilled in the art, the foregoing descriptions of the preferred embodiment of the present invention are an illustration of the present invention rather than a limitation thereof. It is intended to cover various modifications and similar arrangements included within the spirit and scope of the appended claims. While a preferred embodiment of the invention has been illustrated and described, it will be appreciated that various changes can be made therein without departing from the spirit and scope of the invention.

The invention claimed is:

1. A DC/AC converter comprising:

power delivery circuitry configured to convert DC power to AC power to be supplied to a plurality of loads;

at least one common mode choke coupled to said plurality of loads for balancing current flowing through said plurality of loads; and dual diode circuitry coupled to said common mode choke configured to provide a feedback signal to said power delivery circuitry.

2. The DC/AC converter of claim 1 wherein said power delivery circuitry comprises a power circuit, an isolated transformer connected to said power circuit for changing a voltage transferred from said power circuit, and a plurality of capacitors coupled between said transformer and said loads.

3. The DC/AC converter of claim 2 wherein said power circuit is a full-bridge circuit, half-bridge circuit, a push-pull circuit or a Royer circuit.

4. The DC/AC converter of claim 2 wherein each of said capacitors is coupled to a respective one of said loads.

5. The DC/AC converter of claim 2 wherein one of said capacitors is coupled to all of said loads.

6. The DC/AC converter of claim 1 wherein said at least one common mode choke includes a plurality of common mode chokes coupled to said loads.

7. The DC/AC converter of claim 1 wherein said at least one common mode choke is coupled between said power delivery circuitry and said loads, and wherein said dual diode circuitry is coupled between said loads and said power delivery circuitry.

8. The DC/AC converter of claim 1 wherein said loads are coupled to said power delivery circuitry, and wherein said dual diode circuitry is coupled between said at least one common mode choke and said power delivery circuitry.

9. The DC/AC converter of claim 1 wherein said loads are cold cathode fluorescent lamps.

10. A DC/AC converter comprising:

power delivery circuitry configured to convert DC power to AC power to be supplied to a plurality of loads; and a plurality of common mode chokes coupled to said plurality of toads for balancing current flowing through said plurality of loads, wherein one of said common mode chokes is coupled to two of said plurality of loads, and wherein others of said common mode chokes are coupled between one of said common mode chokes and one of said plurality of loads.

11. The DC/AC convert of claim 10 wherein said power delivery circuitry comprises a power circuit, an isolated transformer connected to said power circuit for changing a voltage transferred from said power circuit, and a plurality of capacitors coupled between said transformer and said loads.

12. The DC/AC converter of claim 11 wherein said power circuit is a full-bridge circuit, half-bridge circuit, a push-pull circuit or a Royer circuit.

13. The DC/AC converter of claim 11 wherein each of said capacitors is coupled to a respective one of said loads.

14. The DC/AC converter of claim 11 wherein one of said capacitors is coupled to all of said loads.

15. The DC/AC converter of claim 10 wherein said common mode chokes are coupled between said power delivery circuitry and said loads.

16. The DC/AC converter of claim 15 further comprising dual diode circuitry coupled between said loads and said power delivery circuitry, for providing a feedback signal to said power delivery circuitry.

17. The DC/AC converter of claim 10 wherein said loads are coupled to said power delivery circuitry.

18. The DC/AC converter of claim of claim 17 further comprising dual diode circuitry coupled between one of said common mode chokes and said power delivery circuitry, for providing a feedback signal to said power delivery circuitry.

19. The DC/AC converter of claim 10 wherein said loads are cold cathode fluorescent lamps.

20. The DC/AC converter of claim 10 wherein the number of common mode chokes is less than the number of loads.

* * * * *